US010152881B2

(12) United States Patent
Mubarek et al.

(10) Patent No.: US 10,152,881 B2
(45) Date of Patent: Dec. 11, 2018

(54) AUTOMATED TRAFFIC SIGNAL OUTAGE NOTIFICATION BASED ON CONGESTION WITHOUT SIGNAL TIMING AND PHASE INFORMATION

(71) Applicant: HERE Global B.V., Eindhoven (NL)

(72) Inventors: Omer Mubarek, Chicago, IL (US); Bruce Bernhardt, Wauconda, IL (US); Jingwei Xu, Buffalo Grove, IL (US)

(73) Assignee: HERE Global B.V., Eindhoven (NL)

( * ) Notice: Subject to any disclaimer, the term of this patent is extended or adjusted under 35 U.S.C. 154(b) by 0 days.

(21) Appl. No.: 15/337,301

(22) Filed: Oct. 28, 2016

(65) Prior Publication Data

US 2018/0122229 A1 May 3, 2018

(51) Int. Cl.

| | |
|---|---|
| ***G08B 21/00*** | (2006.01) |
| ***G08G 1/01*** | (2006.01) |
| ***G08B 21/18*** | (2006.01) |

(52) U.S. Cl.

CPC ..... *G08G 1/0133* (2013.01); *G08B 21/18* (2013.01)

(58) Field of Classification Search

CPC ..... G08G 1/097; G08G 1/0133; G08B 21/18
USPC ..... 340/907
See application file for complete search history.

(56) References Cited

U.S. PATENT DOCUMENTS

| | | | | |
|---|---|---|---|---|
| 8,694,603 | B2 | 4/2014 | Brobst et al. | |
| 2001/0017933 | A1* | 8/2001 | Chujoh | G08G 1/04 382/104 |
| 2005/0187701 | A1* | 8/2005 | Baney | G08G 1/096716 701/117 |
| 2009/0117923 | A1 | 5/2009 | Berger et al. | |
| 2011/0095908 | A1 | 4/2011 | Nadeem et al. | |
| 2014/0336913 | A1 | 11/2014 | Fino | |
| 2016/0155334 | A1* | 6/2016 | Jansson | G08G 1/164 340/906 |

FOREIGN PATENT DOCUMENTS

| | | |
|---|---|---|
| CN | 105427610 A | 3/2016 |

OTHER PUBLICATIONS

PCT International Search Report and Written Opinion of the International Searching Authority dated Jan. 4, 2018 for corresponding PCT/US2017/055824.

* cited by examiner

*Primary Examiner* — Mark Rushing
(74) *Attorney, Agent, or Firm* — Lempia Summerfield Katz LLC

(57) ABSTRACT

Systems and methods are provided for determining when a traffic signal associated with one or more paths through a road intersection is malfunctioning. Congestion prior to and subsequent to the road intersection is identified from a plurality of probe reports. A malfunctioning traffic signal is determined based on whether or not congestion is identified prior to and subsequent to the road intersection.

17 Claims, 17 Drawing Sheets

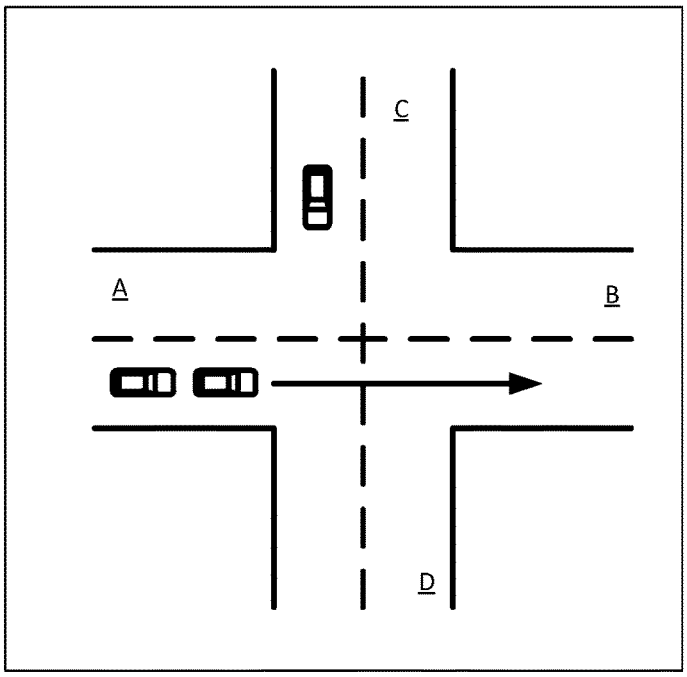
FIG. 1A
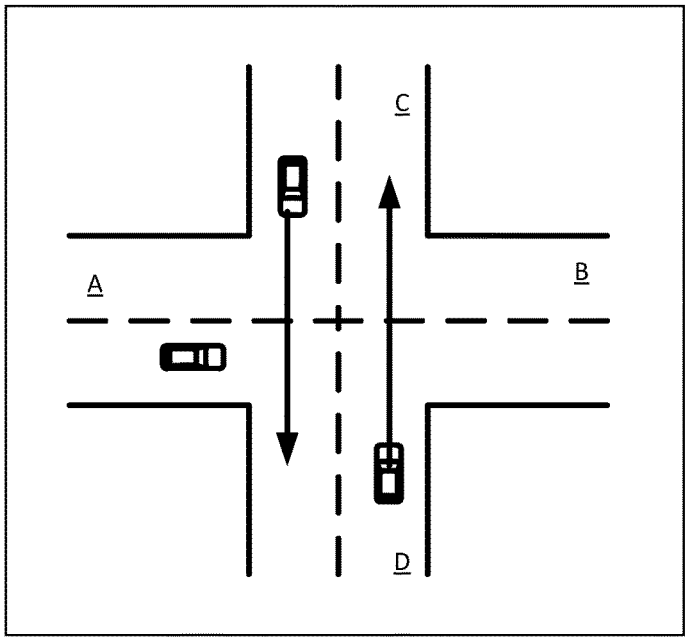
FIG. 1B
FIG. 1

AUTOMATED TRAFFIC SIGNAL OUTAGE NOTIFICATION BASED ON CONGESTION WITHOUT SIGNAL TIMING AND PHASE INFORMATION

FIELD

The following disclosure relates to transportation systems and transit related applications, and more specifically to receiving traffic reports and identifying a traffic signal controlled intersection that is malfunctioning.

BACKGROUND

Intersections between roadways may include a traffic signal to facilitate traffic flow. A traffic signal may be able to provide control strategies for vehicle capacity and safe operation on the roadway. When a traffic signal malfunctions, the traffic flow and safety may quickly diminish resulting in increased congestion and altered traffic patterns. The increased congestion and altered traffic patterns may last for extended periods of time until a responsible party is notified and is able to fix the malfunction.

Certain traffic signals may be directly connected to a central system. The central system may be able to immediately identify when the traffic signals malfunctions. However, many traffic signals are unconnected. For example, many intersections contain legacy equipment that does not support external communication. The traffic signals may not have the ability to report a malfunction. As such, a malfunction may last for extended periods of time. The ability to quickly identify that a traffic light controlled intersection is malfunctioning and report that situation to a traffic management agency, police agencies, and/or vehicles traveling to the intersection is needed to efficiently and effectively provide navigation services.

SUMMARY

In an embodiment a method is provided for determining when a traffic signal associated with one or more paths through a road intersection is malfunctioning. The method comprises receiving a plurality of probe reports from a plurality of devices, identifying whether there is congestion prior to and subsequent to the road intersection for the one or more paths, and determining a traffic signal malfunction based on whether or not congestion is identified prior to and subsequent to the road intersection.

In an embodiment a system is provided for determining when a traffic signal associated with a road intersection is malfunctioning. The system comprises a map database, a sensor ingestion module, a routing module and an analytics module. The map database is configured to store data relating to the road intersection. The sensor ingestion module is configured to receive and store in the map database a plurality of probe reports from a plurality of probe devices. The routing module is configured to generate a plurality of crossing routes for the road intersection for a time period. The analytics module is configured to analyze the plurality of probe reports to determine congestion before and after the road intersection. The analytics module is further configured to determine a number of crossing cycles for the road intersection using the plurality of crossing routes. The analytics module is further configured to determine the traffic signal has malfunctioned when there is congestion before the road intersection for all paths and no congestion after the road intersection for all paths. The analytics module is further configured to determine the traffic signal has malfunctioned when there is congestion in all but one path before the road intersection, no congestion after the road intersection for all paths, and when the number of crossing cycles equals a predefined threshold.

In an embodiment a method is provided for generating an updated route. The method comprises receiving a request for a route, generating the route, providing the route, identifying whether there is congestion prior to and subsequent to a road intersection, determining a traffic signal at the road intersection has malfunctioned based on whether there is congestion, generating an updated route not including the road intersection, and providing the updated route.

BRIEF DESCRIPTION OF THE DRAWINGS

Exemplary embodiments of the present invention are described herein with reference to the following drawings.

FIGS. 1A and 1B illustrate an example traffic light controlled intersection.

DETAILED DESCRIPTION

Embodiments are provided that detect malfunctioning traffic signals that are not connected to a central controller. Embodiments use probe reports to identify congestion and crossing paths. The crossing paths and congestion before and after an intersection are used to identify malfunctioning traffic signals and traffic lights. An alert is transmitted for the malfunctioning traffic signal or light.

FIGS. 1A and 1B depict a four-way intersection. In FIGS. 1A and 1B, the intersection includes four traffic lights; one for each direction (up, down, left, right). For a four-way intersection, the traffic lights may operate in pairs. Two complementary lights of the four lights may correspond to the vertical paths from A to B. Two of the four lights may correspond to the horizontal paths from C to D. In normal operation the horizontal paths (from left to right and right to left) have a green light together while the vertical paths (from top to bottom and bottom to top) have a red light. For traffic signals that include a yellow light, the pattern of operation may be: green light for a first period, yellow light for a second period, and then a red light for a third period. The red light of a complementary traffic light may be used when the first traffic signal is green or yellow prohibiting any two perpendicular streams of traffic from entering the intersection at the same time. The length of the periods for green, yellow, and red may be set to manage traffic flows. For example, a major roadway may have a longer green than a minor roadway at the intersection of the two.

For the traffic signals described herein, the signal, phase, and timing (SPaT) information is not available. The SPaT information may include the timing and cycle for each light of the traffic signal. For connected traffic signals, the SPaT information may be published by a governmental agency and/or accessed over a network. The traffic signals described herein may be standalone traffic signals, e.g. not connected to any external source. The traffic signals may be controlled by a field controller located at the location of the traffic signal. Software embedding in the field controller may control the signal, phase, and timing information without transmitting or making available the SPaT information. In another scenario, the traffic signal may be unable to transmit the SPaT information. For example, a connected traffic signal may be connected to a central entity over a wired network. If the wired network is down, the SPaT information may not be transmitted to a central controller.

Figure 2A:
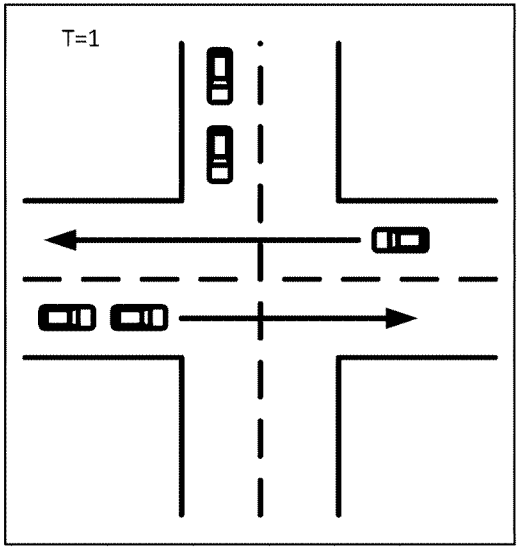
FIGS. 2A, 2B, and 2C illustrate an example intersection with a malfunctioning traffic signal.
Figure 2B:
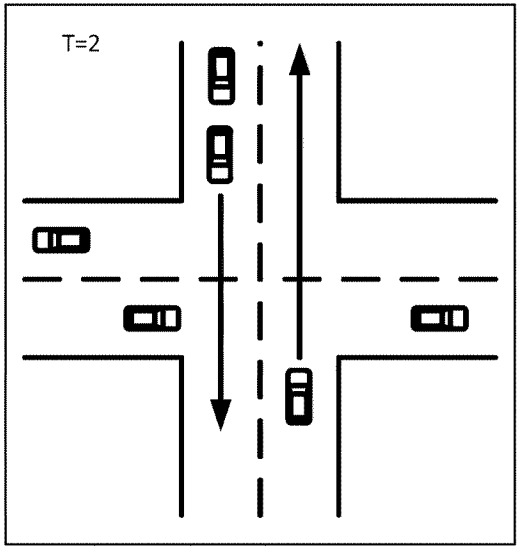
Figure 2C:
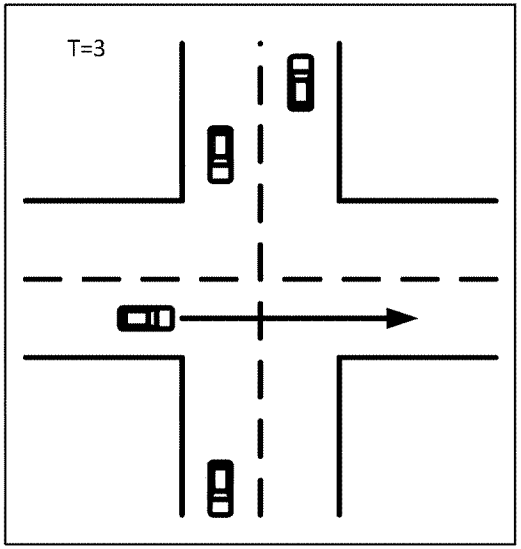

Some causes of malfunctioning traffic signals include controller failure, load switch failure, and voltage problems such as transients, sags, and brief power outages. When a traffic signal malfunctions, the normal flow of traffic may be altered. If the traffic signal is off or flashing red lights (a default operation of a malfunctioning traffic signal) the traffic pattern may resort to a one vehicle (or direction) through the intersection at a time method. The resulting traffic pattern may resemble a four-way intersection with stop signs. Priority right of way rules may be used. In a four-way intersection, traffic from the right generally has priority. For traffic coming from the same or opposite direction, the traffic that goes straight has priority over the traffic that turns. FIGS. 2A, 2B, and 2C illustrate a malfunctioning traffic signal controlled intersection at three different times T=1, T=2, and T=3. In FIG. 2A, one vehicle from each horizontal path may be allowed to cross the intersection. After the vehicles have crossed the intersection, at FIG. 2B, one vehicle from each vertical path may be allowed to cross. At FIG. 2C, after the vertical vehicles have crossed, another vehicle from the horizontal path may cross. The pattern: horizontal, vertical, horizontal, vertical will repeat until the malfunctioning light is fixed.

Any vehicle that approaches the intersection has to wait for all the cars in front of it, as well as vehicles in other directions which are closer to the intersection. In addition to that, the stop-go behavior at the intersection further slows down vehicles. As a result of only one vehicle traversing the intersection at a time, neither direction is expected to experience congestion after the intersection (unless there is another reason for it apart from malfunctioning traffic lights). For each direction, before a vehicle can cross the intersection, the vehicle has to come to a full stop and wait for vehicles in other directions. Hence, there will not be a continuous stream of cars after the intersection in a given direction that would cause congestion. If only one of the traffic signals at an intersection has malfunctioned (e.g. remains red), the traffic pattern may resemble a four-way intersection that has a two-way stop sign.

A traffic signal malfunction may cause multiple issues including but not limited to increase congestion surrounding the intersection, less traffic flow, and increased travel times. Identifying and fixing the traffic signals that have malfunctioned is a high priority to maintain a proper functioning roadway. A current method for identifying traffic signals that are malfunctioning is to receive a message from an observer of the malfunctioning traffic signal. For example, a driver or pedestrian may send a text message or call a general purpose number (e.g. 311) to report the malfunction. Manually reporting the malfunction is inefficient, error prone, and must past through multiple channels. The result is that a malfunctioning traffic light may remain out of service for an extended period of time exacerbating traffic issues.

Traffic patterns may be used to predict a location of a stop sign or traffic signal. For example, in a scenario, each vehicle has a sensor that indicates that every vehicle stopped at a certain point. A stop sign may be derived from the stops and the location. However, the number of sensor vehicles is low. Deriving a stop sign from one or two stops or a simple traffic pattern may lead to many false positives or false negatives. Further data collection and analysis is needed to determine an even more complex, for example, that a traffic signal has malfunctioned.

Embodiments herein provide a system and efficient method for determining that a traffic signal has malfunctioned. The following embodiments identify congestion before and after an intersection. Vehicle paths before, at, and after an intersection are identified. The vehicular crossings of the intersection are recorded for a time period. From the pattern of vehicular crossings and congestion, a malfunction of the traffic signal may be determined.

The disclosed embodiments may be implemented to computationally optimize managing a roadway network and navigation services leading to an improvement in the computational system. The embodiments improve the efficiency and function of a navigation application. The embodiments improve the efficiency and operation of traffic signals by quickly identifying malfunctions. The increased efficiency and usage of resources may lead to less downtime, quicker response time, less congestion, and more efficient use of the roadway network.

Figure 3:
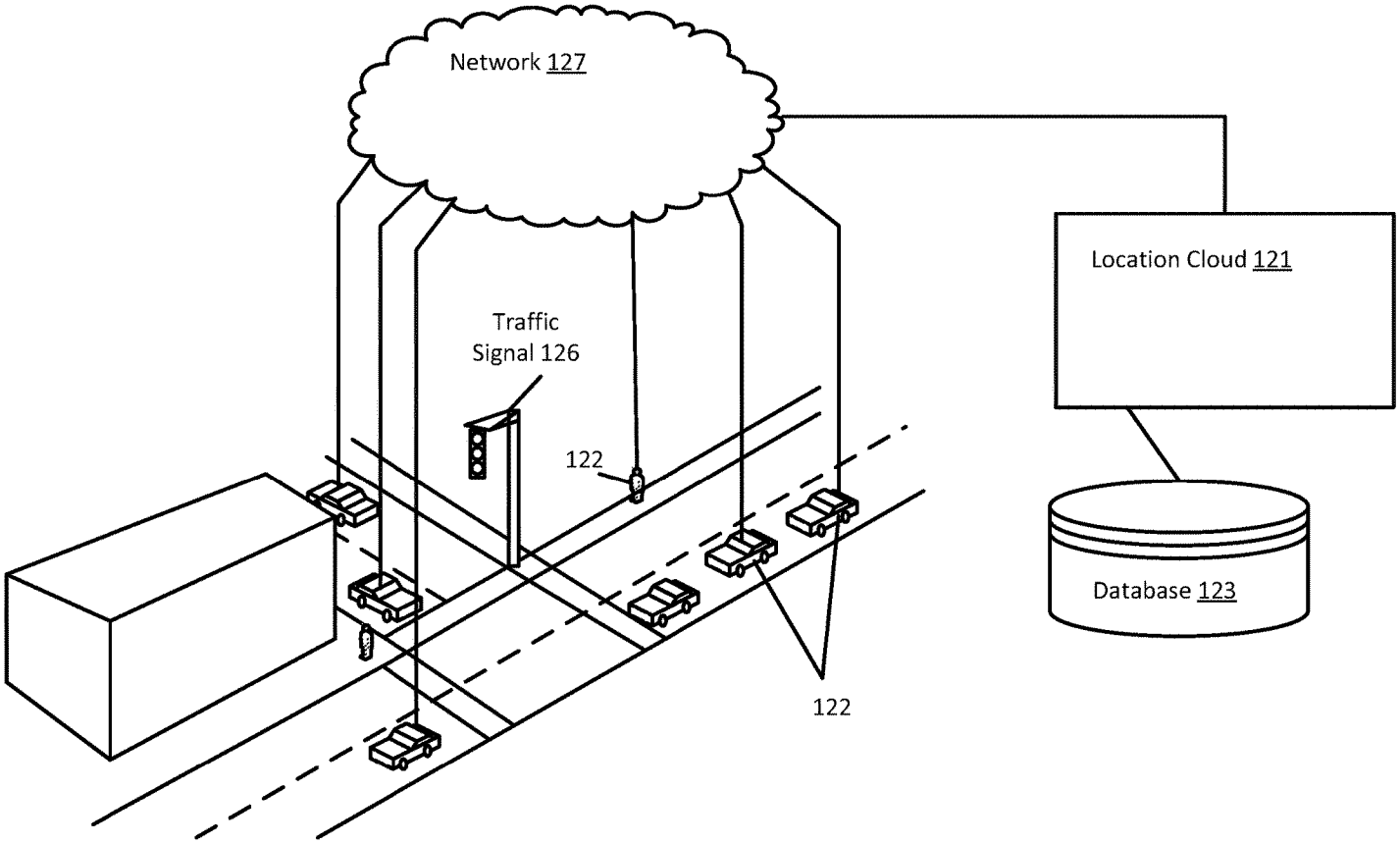
FIG. 3 illustrates an example system for identifying a malfunctioning traffic signal.

FIG. 3 illustrates an example system for identifying a traffic signal malfunction. The system includes one or more devices 122, a network 127, a traffic signal 126, and a location cloud 121. The device(s) 122 are coupled with or wirelessly connected to the network 127 that is coupled with or wirelessly connected to the location cloud 121. Herein, the phrase "coupled with" is defined to mean directly connected to or indirectly connected through one or more intermediate components. Such intermediate components may include both hardware and software based components. Additional, different, or fewer components may be included.

The traffic signal 126 may not be connected to the network, the devices 122, or the location cloud 121. The traffic signal 126 may include one or more traffic lights that facilitate movement of one or more vehicles through an intersection. The SPaT information for the traffic signal 126 may be unknown. In certain embodiments, the SPaT information may be derived from traffic patterns.

The device(s) 122 may be a mobile device or a sensor that provides samples of data for the location of the device 122 or a vehicle. The device(s) 122 may be mobile phones running specialized applications that collect location data as the devices 122 traverse a roadway network. The device(s) 122 may also be integrated in or with a vehicle. Applications, computer sub-systems or sensors that are either standard or optional equipment on a vehicle may collect and aggregate information regarding the operation of the vehicle. The device(s) 122 may also be a sensor or a collection of sensors, such as an inductance loop or optical detector (e.g., camera, light detection and ranging (LiDAR), or radar device). The device(s) 122 may be a camera/imaging sensor for gathering image data (e.g., the camera sensors may automatically capture traffic flow information, abnormal incidents, and/or traffic light information. The device(s) may be sensors located on the perimeter of the vehicle in order to detect the relative distance of the vehicle from lane or roadways, the presence of other vehicles, pedestrians, traffic lights, potholes and any other objects, or a combination thereof. The device 122 may operate from a fixed position and may be permanently deployed or a portable device that is located temporarily in the vicinity of a traffic incident, road construction, or a special event.

The device(s) 122 and/or other sensor(s) may be the means for collecting data from one or more vehicles. The data may be transmitted over the network. The device(s) 122 may also be configured to receive data through the network. The received data may include routing or navigation data, video data, audio data, or data relating to the device 122 or vehicle.

Additional equipment may be included in the system. For example, in certain embodiments, the system may include environmental sensors, connected traffic signals, dynamic message signs, CCTV cameras and video image processing systems, grade crossing warning systems, and ramp metering systems. Lane management systems and barrier systems that control access to transportation infrastructure such as roadways, bridges and tunnels may also be included. Work zone systems including work zone surveillance, traffic control, driver warning, and work crew safety systems may also be included. The equipment may be connected to the network in order to collect and provide information relating to the roadway network.

The network 127 may include wired networks, wireless networks, or combinations thereof. The wireless network may be a cellular telephone network, LTE (Long-Term Evolution), 4G LTE, a wireless local area network, such as an 802.11, 802.16, 802.20, WiMax (Worldwide Interoperability for Microwave Access) network, or wireless short range network such as Dedicated Short Range Communications (DSRC/802.11P). Further, the network 127 may be a public network, such as the Internet, a private network, such as an intranet, or combinations thereof, and may utilize a variety of networking protocols now available or later developed including, but not limited to TCP/IP based networking protocols. The network 127 may be the means for transmission of data between the devices 122, the location cloud 121, and/or other equipment or devices in the system.

The location cloud 121 may include one or more servers, workstations, databases, and other machines connected together and maintained by a manager of connected vehicle data, including but not limited to map, sensor, wireless network, temporal climate and incident data. The term location cloud 121 is used herein to collectively include the ingestion, analytic/computational, interface API's and message distribution capabilities residing in both local and cloud based systems including the systems used for creating, maintaining, accessing, and updating one or more database(s) 123. The location cloud 121 (or traffic management system) may include one or more server(s) 125 or modules such as a sensor ingestion server, a traffic management server, and/or an analytics server. The location cloud 121 may also include a database 123. The location cloud 121 may be configured to provide up to date information and maps to external map databases or mapping applications. The location cloud 121 collects or ingests data from multiple sources, such as through the network 127, in order to maintain up to date roadway conditions. Data such as device data, sensor data, weather, road conditions, traffic flow, and historical data is processed to determine current and future traffic conditions. The location cloud 121 may generate map updates, such as real time traffic updates, turn by turn directions, public transportation routes and information about local business and attractions.

The location cloud 121 may be the means for determining a status of a traffic signal 126 from collected data. The location cloud 121 may be configured to update a map database 123, generate a route, or transmit an alert message related to the status of the traffic signal 126. The location cloud 121 may receive information relating to one or more devices 122 over the network 127. The location cloud 121 may be configured to estimate a device's 122 path based on the received information. The location cloud 121 may be configured to determine congestion before and after an intersection. The location cloud 121 may be configured to identify congestion that relates to a signal outage. The location cloud 121 may be configured to determine a malfunction of a traffic signal 126 from the congestion and device paths. The location cloud 121 may store the traffic patterns and malfunctions in the database 123. The location cloud 121 may be configured to generate messages for transmission to devices 122 describing preemptive actions to be taken to avoid malfunctioning traffic signals 126.

The database 123 (also referred to as a dynamic content database, sensor ingestion database, traffic database, map database or geographic database) may include geographic data used for traffic or navigation related applications. In order to provide navigation related features and functions to the end user, the location cloud 121 uses the geographic database 123. The geographic database 123 includes information about one or more geographic regions including attributes and data relating to one or more nodes, one or more road segments, and one or more traffic intersections. The geographic database 123 may further include data relating to one or more traffic signals 126.

Figure 4:
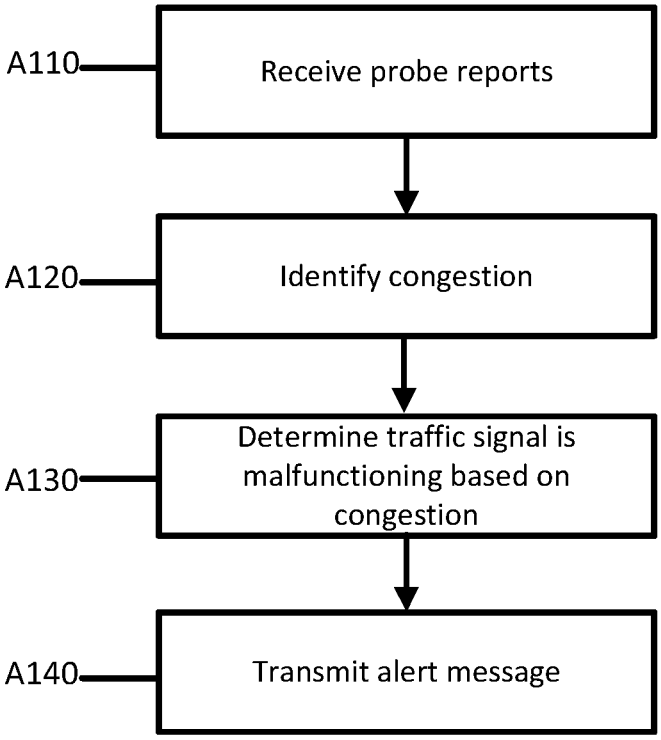
FIG. 4 illustrates an example workflow for identifying a malfunctioning traffic signal.

FIG. 4 illustrates a flow chart of a method for identifying a malfunctioning traffic signal using the system of FIG. 3. As presented in the following sections, the acts may be performed using any combination of the components indicated in FIG. 3. Additional, different, or fewer acts may be provided. The acts are performed in the order shown or other orders. The acts may also be repeated.

At Act A110, the location cloud receives a plurality of probe reports from a plurality of devices. The device 122 may be a vehicle that has traveled through the intersection. A report (or probe report) from a device 122 may include information such as location, speed, and time of the device 122. Location data may be derived from a positioning sensor such as a global positioning system (GPS) device. The speed of the device 122 may be determined by one or more sensors. The speed may be derived from two or more reports from the device 122 if the reports include location and time. Additional data relating to the device 122, vehicle, or roadway may be included in the report. The probe reports may be received separately or together in a group or batch.

The probe reports may be received in real-time or may be delayed due to network equipment or latency.

At Act A120, the location cloud identifies a level of congestion for locations on a path prior to and subsequent to the intersection. Congestion may be identified by using location and timing data from the plurality of probe reports. Speed data or other sensor data may also be used to detect congestion. Congestion may be quantified in multiple ways. A simple method may determine if any vehicles are queued up (congested) at the intersection or not (not congested). For example, one, two, three or more stationary vehicles prior to an intersection may be considered a congested segment.

Congestion may be measured using a level of service (LOS) designation. LOS designations may run from level A to F and describe the traffic flow of a roadway. The levels for roadways are described as follows. For level A, the traffic flow is in free flow. Traffic flows at or above the posted speed limit and motorists have complete mobility between lanes. The average spacing between vehicles is about 550 feet (ft) (167 meters (m)) or 27 car lengths. For level B, the traffic flow is reasonably free flow. Speeds are maintained, maneuverability within the traffic stream is slightly restricted. The lowest average vehicle spacing is about 330 ft (100 m) or 16 car lengths. For level C, the traffic flow is stable flow, at or near free flow. The ability to maneuver through lanes is noticeably restricted and lane changes require more driver awareness. Minimum vehicle spacing is about 220 ft (67 m) or 11 car lengths. For level D, the traffic flow is approaching unstable flow. Speeds slightly decrease as traffic volume slightly increases. The freedom to maneuver within the traffic stream is much more limited and driver comfort levels decrease. Vehicles are spaced about 160 ft (50 m) or 8 car lengths. For level E, the traffic flow is unstable flow, operating at capacity. Flow becomes irregular and speed varies rapidly because there are virtually no usable gaps to maneuver in the traffic stream and speeds rarely reach the posted limit. Vehicle spacing is about 6 car lengths, but speeds are still at or above 50 mi/h (80 km/h). For level F, traffic flow is forced or breakdown flow. Every vehicle moves in lockstep with the vehicle in front of it, with frequent slowing required. Travel time cannot be predicted, with generally more demand than capacity.

The location cloud may use levels A through C for a road segment, for example, to determine "no congestion" prior to an intersection or levels A through D to determine "no congestion" after an intersection. Levels E and F may always be considered congested. Congestion and the level of service may be determined based on current probe reports at the intersection. Congestion may be aggregated over a number of lanes or may be reported for each individual lane that has a signal light.

Congestion may also be measured using level of service definitions for signalized intersections as follows. For signal level A, there is uncongested operation in the intersection; all queues clear in a single signal cycle. For signal level B, there is very light congestion; an occasional approach phase is fully utilized. For signal level C, there is light congestion; occasional backups on critical approaches. For signal level D, there is significant congestion on critical approaches, but the intersection is functional. Vehicles are required to wait through more than one cycle during short peaks. No long-standing queues formed. For signal level E, there is severe congestion with some long-standing queues on critical approaches. Blockage of intersection may occur if traffic signal does not provide for protected turning movements. A traffic queue may block nearby intersections(s) upstream of critical approach(es). For signal level F, there is total breakdown, e.g. stop-and-go operation.

For the signalized level of service, levels A and B may be considered to have no congestion. Levels C through F may be considered congested. Each intersection (or type of intersection) may have a different cutoff between a designation of no congestion and congestion including possibly different cutoffs for the location prior to and subsequent to the intersection.

At act A130, the location cloud determines that a traffic signal for an intersection is malfunctioning based on the identified congestion. The following scenarios in FIGS. 5 through 8 describe the situations that indicate whether a traffic signal is malfunctioning or working properly.

Figure 5:
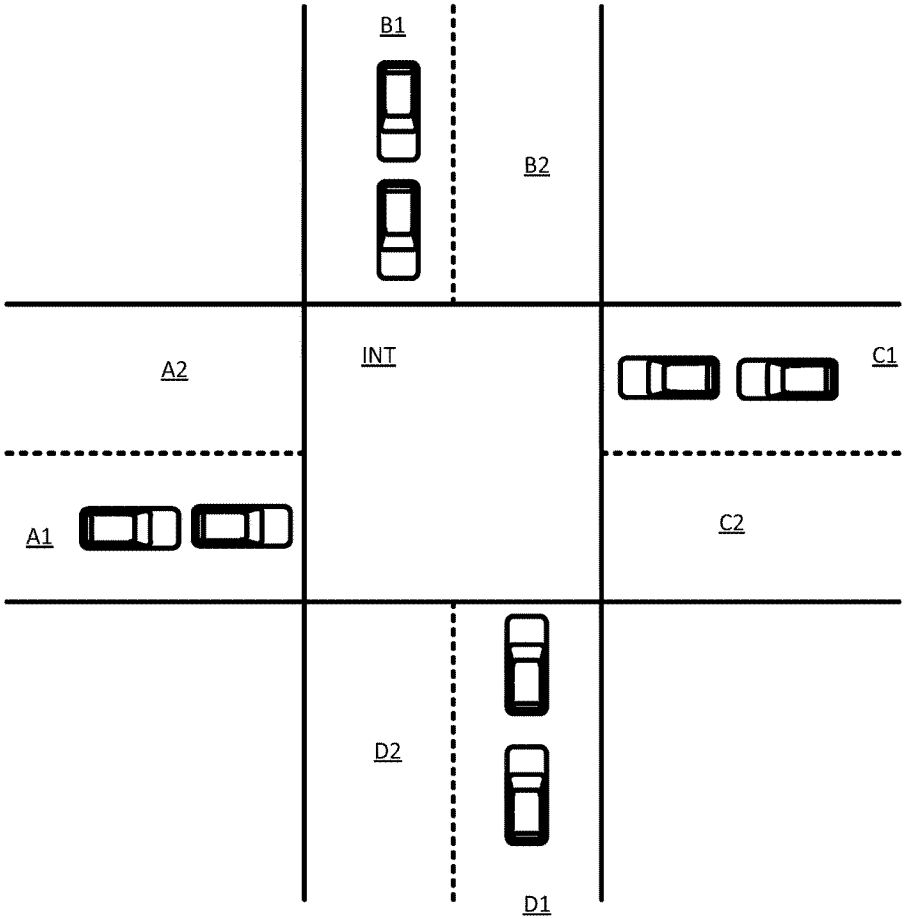
FIG. 5 illustrates an example scenario depicting congestion at an intersection.

FIG. 5 depicts an example intersection where all directions experience congestion before the intersection and no directions experience congestion after the intersection. FIG. 5 depicts a four-way intersection. There are four straight paths through the intersection (INT) are from A1 to C2; D1 to B2, B1 to D2, and C1 to A2. Certain intersection may have more or less paths including, for example, paths for turning lanes. Vehicles depicted in FIG. 5-8 without an arrow are stationary. Two or more stationary vehicles at a location may indicate congestion. As depicted in FIG. 5, there is congestion at A1, B1, C1, and D1. There is no congestion at A2, B2, C2, and D2. The congestion pattern indicates a traffic light outage, where all lights are treated as a stop sign. Vehicles back up before the intersection INT (A1, B1, C1, and D1) and there is no congestion after the intersection INT (A2, B2, C2, or D2) for any route as at any time only one vehicle passes through the intersection per route alleviating congestion after the traffic signal. When a pattern like FIG. 5 is identified, the location cloud may determine that the intersection includes a malfunctioning traffic signal.

Figure 6:
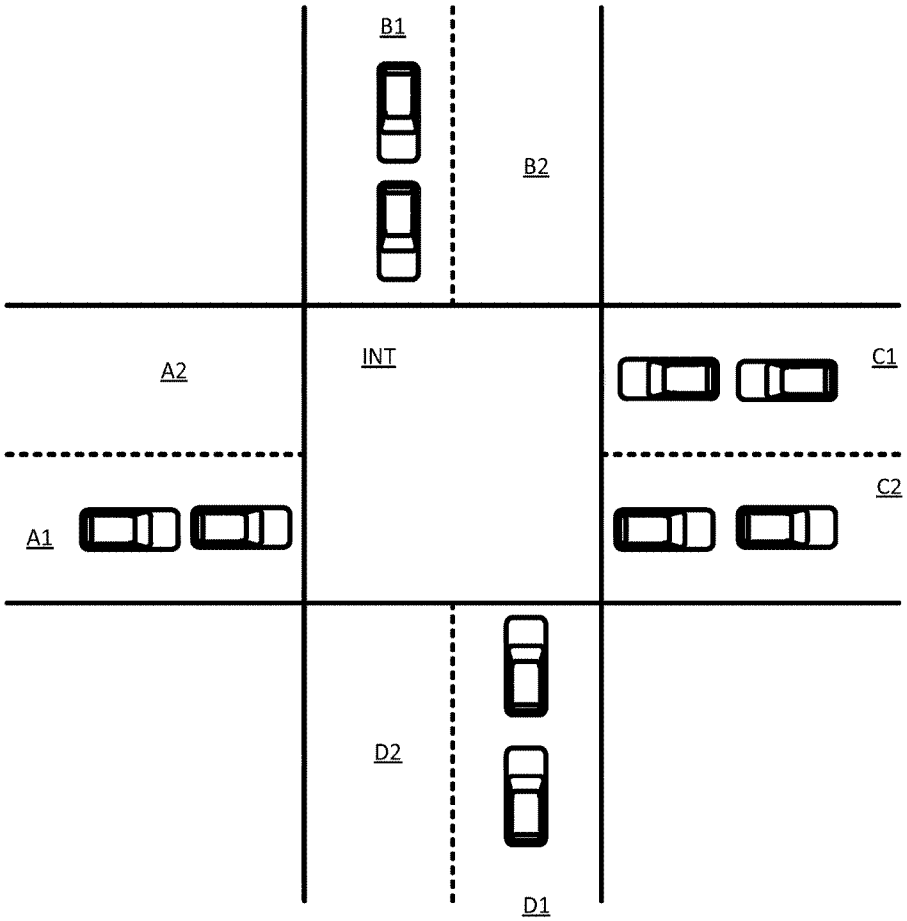
FIG. 6 illustrates another example scenario depicting congestion at an intersection.

FIG. 6 depicts an example intersection where all directions experience congestion before the intersection and at least one direction experiences congestion after the intersection. As depicted in FIG. 6, there is congestion at A1, B1, C1, C2, and D1. The congestion after the intersection (at C2) in one of the routes may be a reason for congestion on that route (A1-C2) before the intersection (at A1). Vehicles on that route may not be able to pass through the intersection. Accordingly, the location cloud may not be able to determine the traffic signal is malfunctioning.

Figure 7:
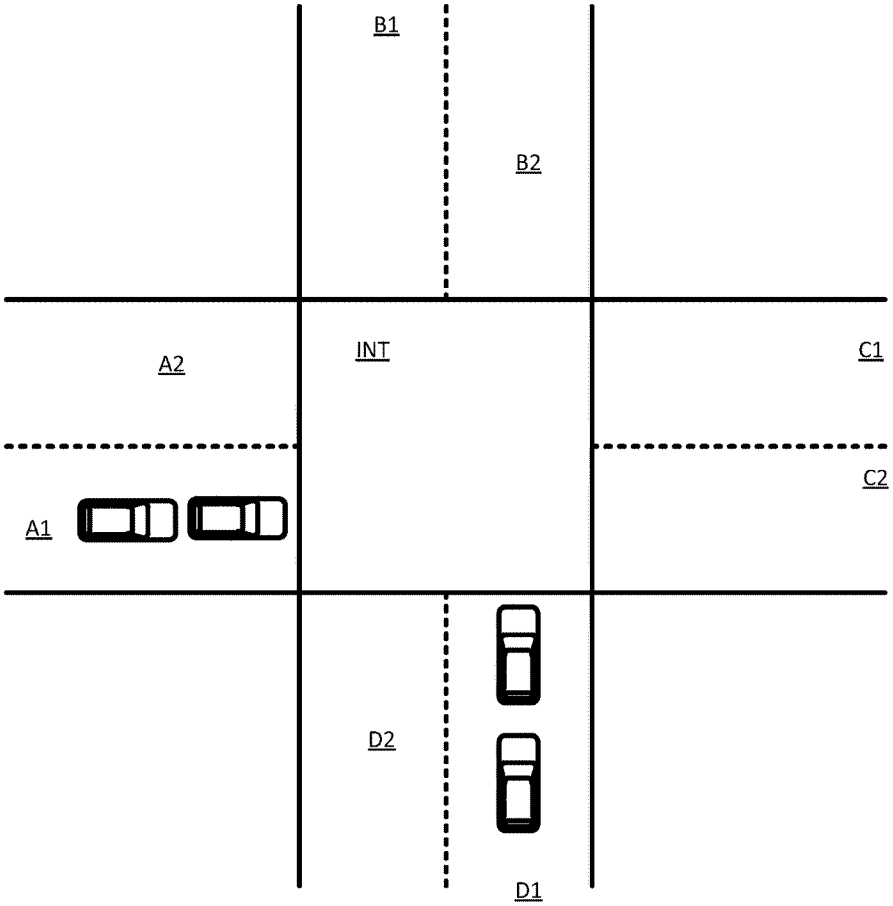
FIG. 7 illustrates another example scenario depicting congestion at an intersection.

FIG. 7 depicts an example intersection where one or more directions has congestion prior to the light, but neither direction experiences congestion after the light. In FIG. 7, there is congestion at A1 and D1. There is no congestion at B1, C1, A1, B2, C2, or D2. Similar to the scenario in FIG. 6, the scenario here does not contain enough information for the location cloud to determine that a light has malfunctioned. The lack of congestion on the other routes may indicate that just those two road segments are busy.

Figure 8:
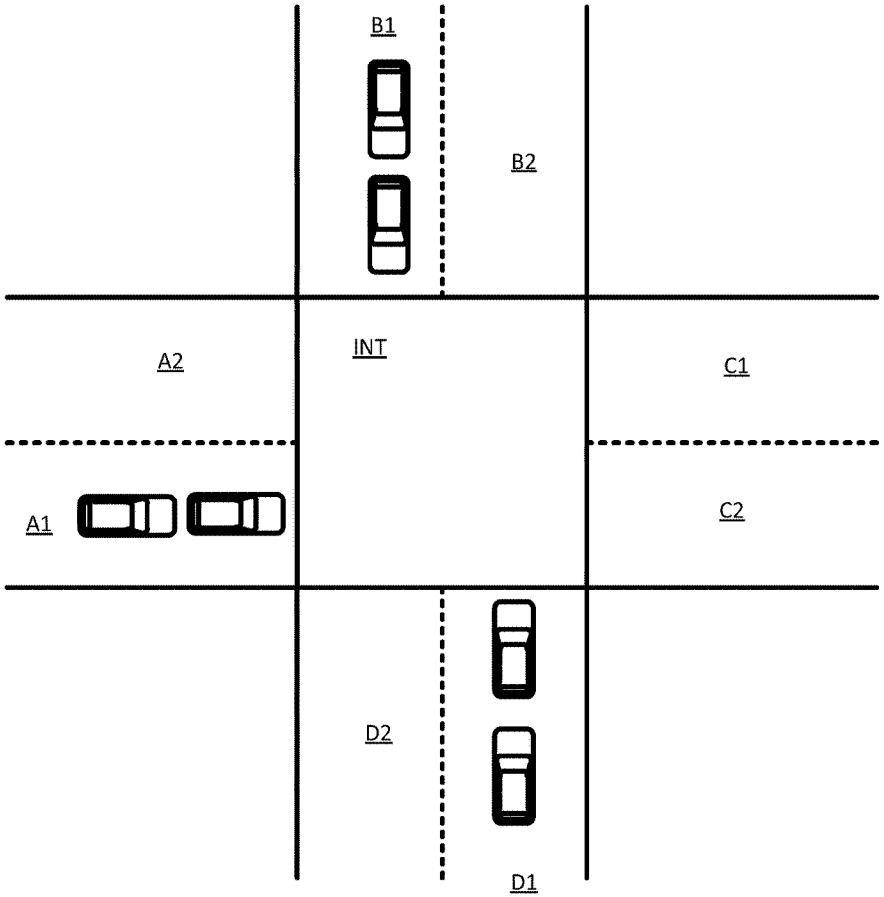
FIG. 8 illustrates another example scenario depicting congestion at an intersection.

FIG. 8 depicts an example intersection where all but one direction experiences congestion before the intersection and no directions experience congestion after the intersection. In FIG. 8, there is congestion at A1, D1, and B1. There is no congestion at C1, A2, B2, C2, or D2. The scenario in FIG. 8 may indicate a traffic signal malfunction. However, before the location cloud may make this determination, more information may be needed. The extra information may be needed to rule out that the lack of congestion in C1 is due to lack of vehicles on that route and not because that route has a properly functioning green light which avoids congestion. If C1 has a properly functioning light, then none of the lights in the traffic signal are malfunctioning.

In order to rule out the lack of congestion, the location cloud may use pattern recognition. Crossing cycles (e.g. the time period where all directions get one turn of right of way) are used to identify if C1 has a working light or if the traffic signal has malfunctioned. In a crossing cycle a direction may or may not provide a vehicle to cross the intersection. In the scenario described at FIG. 8, each of the other directions will provide a vehicle as they are congested, while C1 will sporadically provide a vehicle. If within a time period of T, N crossing cycles are recorded where one vehicle from each direction crosses the intersection consecutively, then the location cloud may determine there is an intersection wide traffic light outage. Otherwise, the location cloud determines that lights and traffic signal are working properly. In an example, a number of crossing cycles (threshold crossing cycles) N=five, and there are four directions. The location cloud identifies the following sequence of crossing cycles (expressed as total number of vehicles provided by all directions in that cycle) within time T: 4-4-3-3-3-4-3-4-3-4-3-4-4-3. Within time period T there are seven crossing cycles where all directions provided a vehicle to cross the intersection (occurrences of '4'). The threshold number of crossing cycles N is five; therefore, the location cloud determines there is a malfunction. The threshold number of crossing cycles may be 2, 3, 5, or 10 crossing cycles for example or other whole number. The threshold number of crossing cycles may be adjusted up and down to exclude false positives or false negatives.

In addition to a fully malfunctioning traffic signal, individual traffic lights in a traffic signal may malfunction. In such a scenario, one direction may have a red light for long periods of time. When a single traffic light at an intersection is stuck at red, traffic on stuck direction will not cross the intersection, whereas vehicles in other directions will go multiple times through their light cycles (where they will wait for their turn if their light is red and will cross the intersection if their light is green).

Figure 9B:
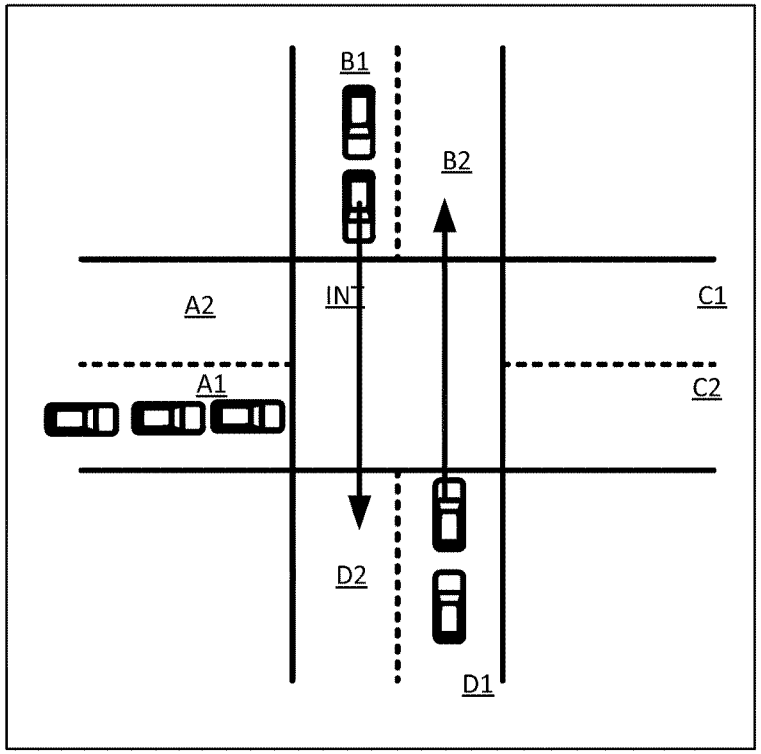
FIGS. 9A and 9B illustrates an example scenario depicting crossing cycles of an intersection.
Figure 9A:
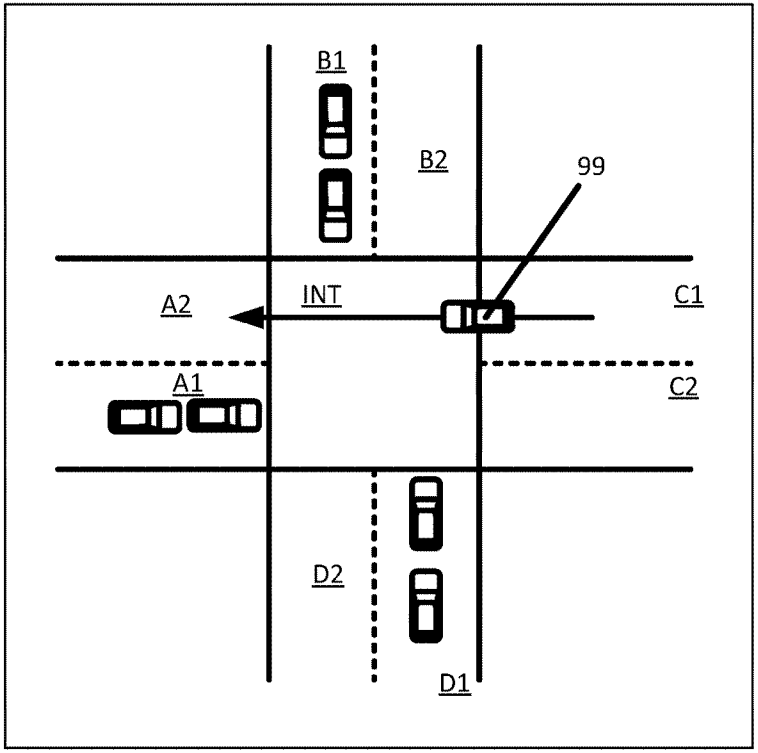

The location cloud may use data from the probe reports and congestion information to detect when such a scenario occurs. FIGS. 9A and 9B depict an example of an intersection with a malfunctioning traffic light.

In FIG. 9A, A1 has no congestion with no vehicles crossing the intersection. C2 has no congestion. Each of the other routes has some volume of traffic. Vehicles such as Vehicle 99 cross the intersection. Next, as depicted in FIG. 9B, vehicles from B1 and D1 cross the intersection. This cycle repeats for multiple times for the B1, C1, and D1 routes while traffic volume at A1 continues to grow. If this pattern is detected by the location cloud for more than a threshold count times, the location cloud will flag the single traffic light at A1 as malfunctioning. The threshold count time is a tunable parameter that determines how many times the cycle must be repeated before reporting that the traffic light is stuck at red. The threshold count time may be greater than two in order to exclude scenarios where a vehicle or driver at A1 is not paying attention to the light.

Each of the above scenarios deal with a simple red/green/yellow light and straight paths. The same scenarios and rules may be applied to more complex lights such as turn signals. There are two categories of turning lanes: a) turning lanes with a dedicated traffic light and b) turning lanes that share a traffic light with a route that goes straight through the intersection. Turning lights may share the same regions prior to the intersection (for example A1 in the above used examples) and the same INT region. However, turning paths have a different end point (for example, B2 in the above used examples).

Turning lanes with dedicated traffic lights may be treated the same way as straight-going routes. A turning route controlled by a dedicated traffic light experiences same vehicle behavior as a straight path. In both cases vehicles wait when the light is red and cross the intersection when it is green. In other words, similar to a straight path, a turning path does not have yield to vehicles from another path. Congestion affects vehicle behavior in both paths the same way.

A turning route without a dedicated traffic light may be treated differently as it exhibits different vehicle behavior. Vehicles in a turning lane yield to opposite traffic. Quite often multiple vehicles move into the center of the intersection, waiting for an opportunity to turn. When their (and opposite direction's) traffic light switches from green to red, according to traffic rules only one vehicle is allowed to make a turn. However, in real life it is common to see multiple vehicles already in the intersection making a turn after the light turns red. Using additional crossing cycles or light cycles (increasing the thresholds) may exclude these occurrences.

At Act A140, the location cloud transmits a malfunctioning traffic signal alert message for the traffic signal. Once a traffic light malfunction is determined, the location cloud 121 may update the map database 123 and send out an alert. The map database 123 may be used to generate routes or for other navigational services. A malfunctioning traffic light may affect the traffic pattern and travel times. The location cloud 121 may transmit an alert to vehicles within a threshold range of the malfunctioning light. Any vehicle that may avoid the expected traffic congestion may be sent an alternative route.

In certain embodiments, an autonomous vehicle may take action when a malfunctioning traffic signal 126 is identified. As described herein, an autonomous driving vehicle may refer to a self-driving or driverless mode that no passengers are required to be on board to operate the vehicle. An autonomous driving vehicle may be referred to as a robot vehicle or an autonomous driving vehicle. The autonomous driving vehicle may include passengers, but no driver is necessary. Autonomous driving vehicles may park themselves or move cargo between locations without a human operator. Autonomous driving vehicles may include multiple modes and transition between the modes.

As described herein, a highly assisted driving (HAD) vehicle may refer to a vehicle that does not completely replace the human operator. Instead, in a highly assisted driving mode, the vehicle may perform some driving functions and the human operator may perform some driving functions. Vehicles may also be driven in a manual mode that the human operator exercises a degree of control over the movement of the vehicle. The vehicles may also include a completely driverless mode. Other levels of automation are possible.

The autonomous or highly automated driving vehicle may include sensors for identifying the surrounding environment and location of the car. The sensors may include GNSS, light detection and ranging (LIDAR), radar, and cameras for computer vision. Proximity sensors may aid in parking the vehicle. The proximity sensors may detect the curb or adjacent vehicles. The autonomous or highly automated driving vehicle may optically track and follow lane markings or guide markings on the road.

Autonomous or highly automated driving vehicle may require high definition up to date maps. Identifying a malfunctioning light not only assists in identifying hazards (or potentially unexpected stopped traffic), but also may help with routing decisions (e.g. avoiding highly congested areas). The location cloud 121 may communicate with the highly automated driving vehicle directly or may provide alerts or updates to a locally stored map. The location cloud 121 may communicate alerts regarding the traffic light malfunction using the network. The location cloud 121 may send a message or alert to an agency, entity, or server that is responsible for fixing the malfunctioning traffic signal 126.

Figure 10:
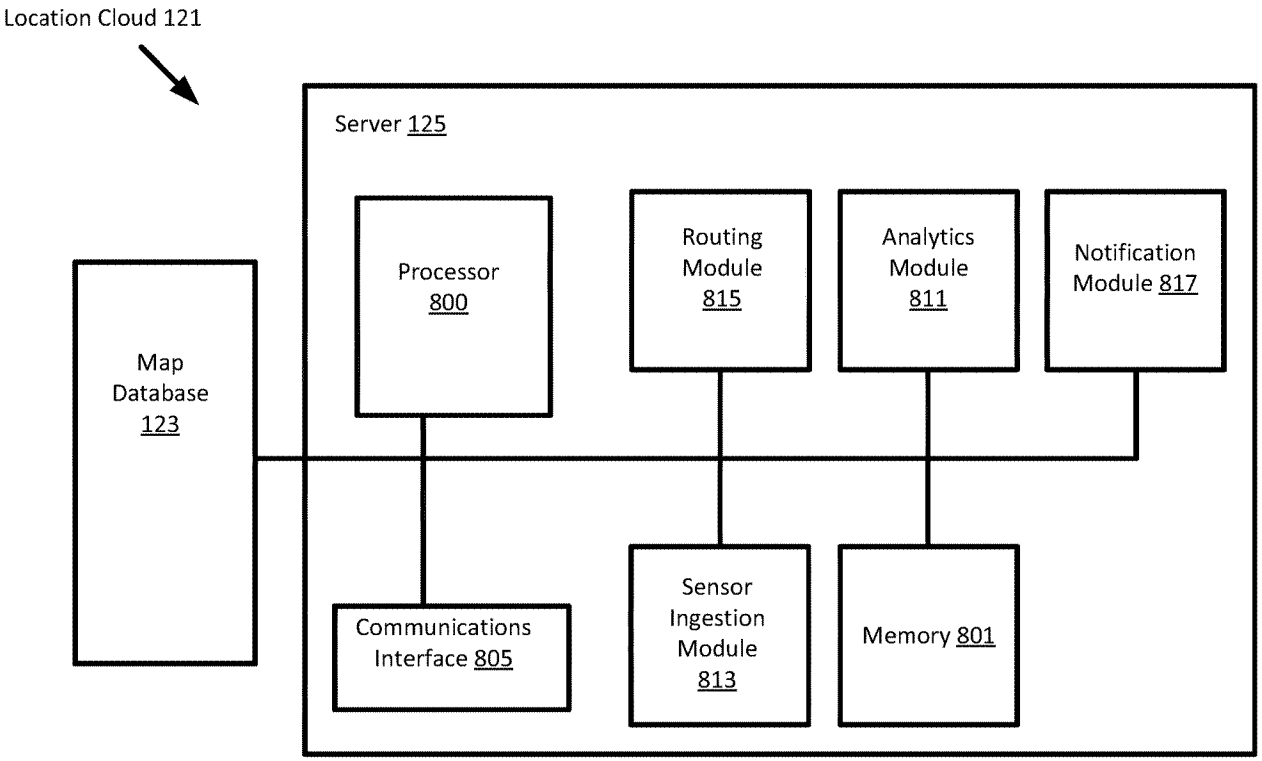
FIG. 10 illustrates an example location cloud of the system of FIG. 3.

FIG. 10 illustrates an example location cloud 121 of FIG. 3. The location cloud 121 includes a server 125 and a database 123. The server 125 may include a sensor ingestion module 813, an analytics module 811, a routing module 815, a notification module 817, a processor 800, a communications interface 805, and a memory 801. The processor 800 may be connected to the database 123. Each of the modules may be included within the processor 800 or may be separate processing centers, servers, or devices. Each of the modules may also be connected to the database 123 in order to access current and historical traffic data.

The server 125 and associated modules are configured to receive probe reports or messages using the communications interface 805. The server 125 may be configured to identify one or more malfunctioning traffic lights or signals using data from the probe reports. The server 125 may be configured to generate an alert in response to determining that a traffic light or signal has malfunctioned. The server 125 may be configured to communicate preemptive measures to one or more connected devices 122 in response to the malfunctioning traffic light or signal.

The processor 800 may be the means to receive collected data from the device(s), determine a traffic light has malfunctioned and generate an alert. The processor 800 may be configured to request and receive data through the communication interface. The processor 800 may also be configured to access the database 123 including current and historical traffic data.

The sensor ingestion module 813 may be the means for receiving probe reports through the communications interface 805 and identifying data such as location and timing data. The sensor ingestion module 813 may be configured to aggregate probe reports for each device 122.

The routing module 815 may be the means for generating routes and determining vehicle flow on roadways. The routing module 815 may be configured to retrieve data from the database 123 regarding the roadways and current or historical traffic patterns. The routing module 815 may be configured to map match location estimates from the probe reports. The routing module 815 may be configured to identify a number of stationary vehicles at each entrance to an intersection. The routing module 815 may be configured to identify one or more devices or vehicles within a predetermined range of an intersection from the probe reports. The routing module 815 may be configured to generate alternative routes for devices or vehicles that are expected to encounter altered traffic patterns due to a malfunctioning traffic signal.

The analytics module 811 may be the means for determining congestion at an intersection and if a traffic signal has malfunctioned. The analytics module 811 may be configured to analyze the plurality of probe reports to determine if congestion exists on paths before and after the intersection. The analytics module may be configured to determine a number of crossing cycles for the road intersection using the plurality of crossing routes determined by the routing module 815. The analytics module 815 may be configured to identify a malfunctioning traffic signal when there is congestion before the intersection for all paths and no congestion after the intersection for all paths. The analytics module 815 may be configured to identify a malfunctioning traffic signal when there is congestion in all but one path before the intersection, no congestion after the intersection for all paths, and when the number of crossing cycles exceeds a predefined threshold.

The notification module 817 may be the means for generating and transmitting notification or alerts. The notification module 817 may be configured to transmit an alert message for the traffic signal when there is congestion before the intersection for all paths and no congestion after the intersection for all paths. The notification module 817 may be configured to transmit the alert message for the traffic signal when there is congestion in all but one path before the intersection, no congestion after the intersection for all paths, and when the number of crossing cycles exceeds a predefined threshold. The notification module 817 may generate and transmit alerts to an agency responsible for the traffic signal 126, devices 122 connected to the network, and other navigation applications or services. The notification module 817 may transmit an alert to only those devices that are within a predetermined range of the intersection. The notification module 817 may transmit alerts relating to altered traffic patterns due to the malfunctioning traffic signal. The notification module may update one or more map databases 123 with the status of a traffic signal, the status of an intersection, or updated traffic patterns.

Figure 13:
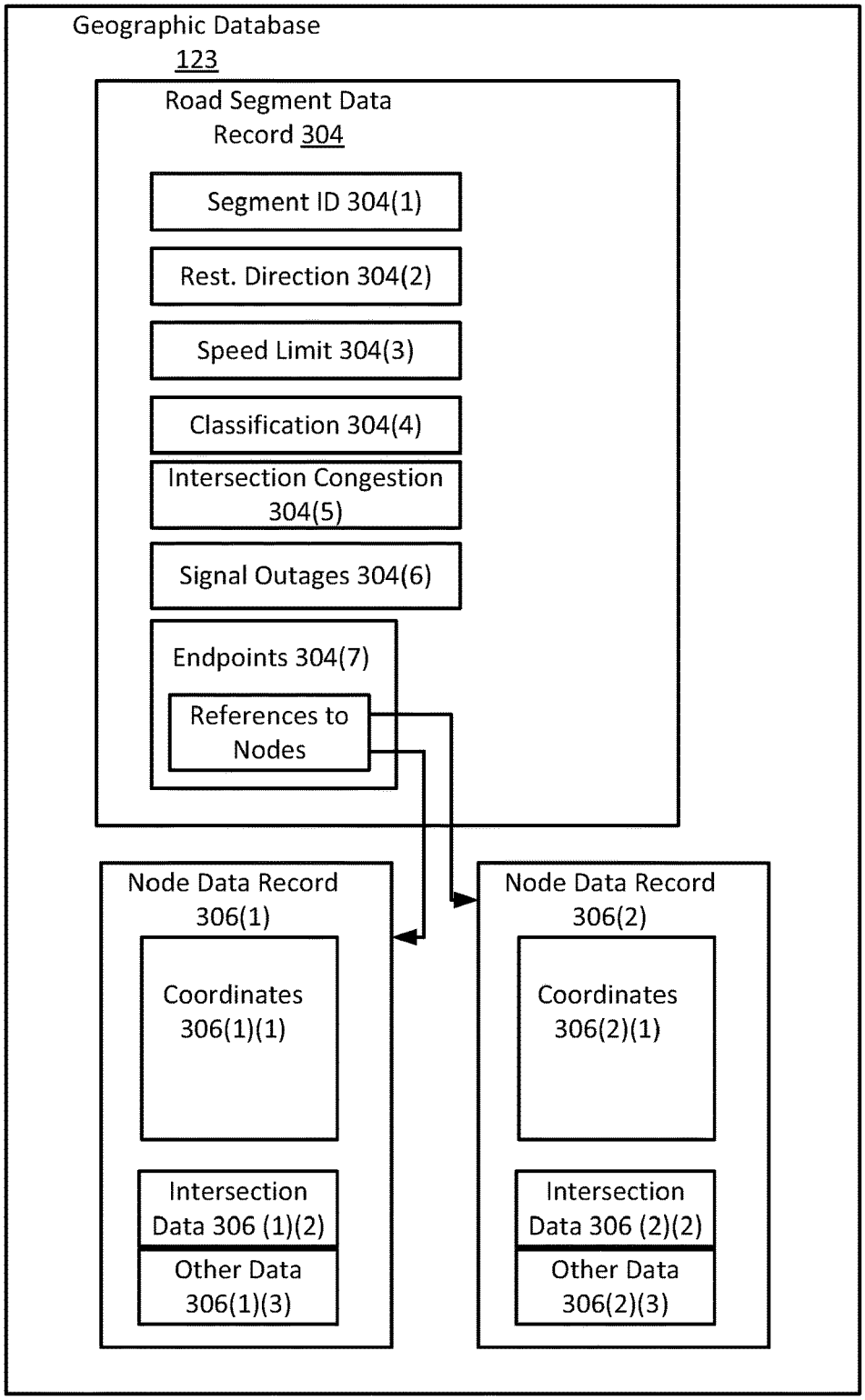
FIG. 13 illustrates example components of the geographic database of FIG. 12.

The database 123 may be configured to store a map and map attributes for a geographic region. FIG. 13 illustrates an example map of a geographic region 202. The geographic region 202 may correspond to a metropolitan or rural area, a state, a country, or combinations thereof, or any other area. Located in the geographic region 202 are physical geographic features, such as roads, points of interest (including businesses, municipal facilities, etc.), lakes, rivers, railroads, municipalities, etc.

Figure 11:
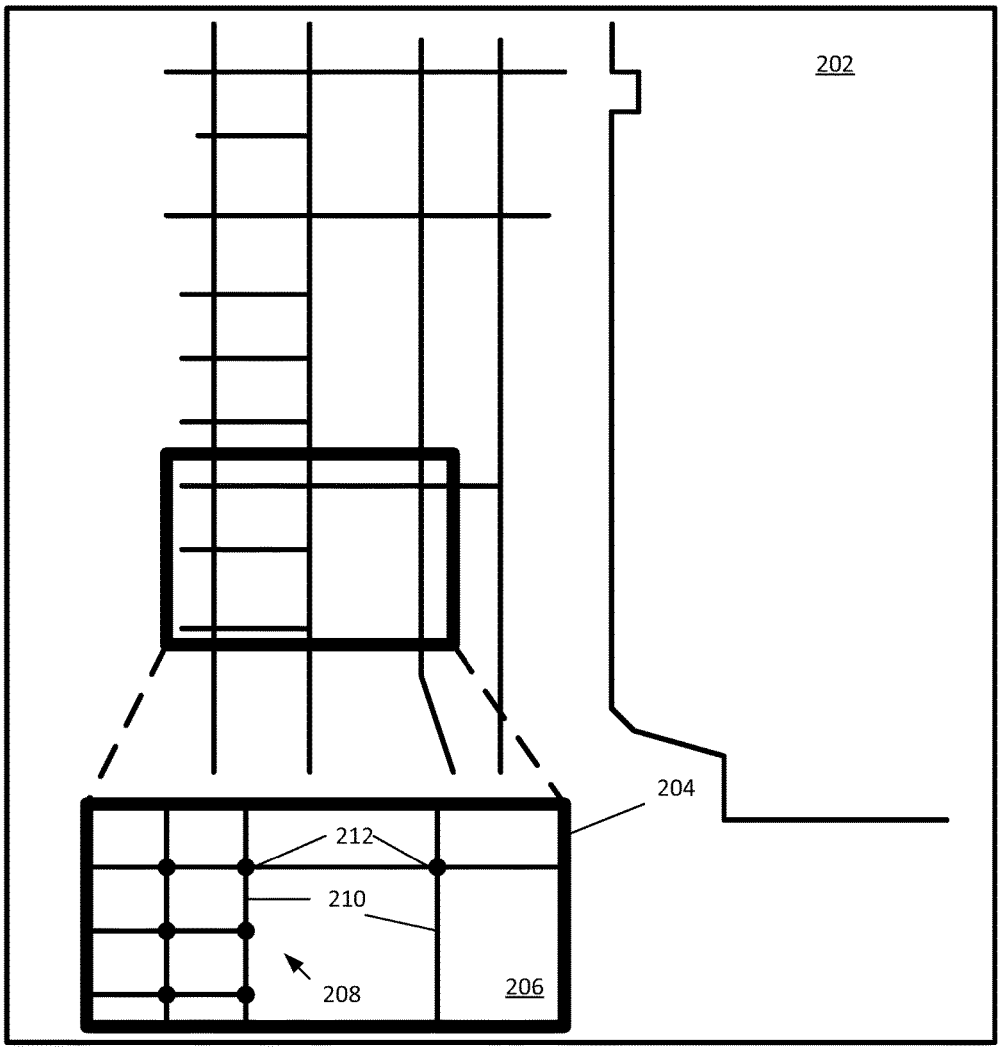
FIG. 11 illustrates an example map of a geographic region.

FIG. 11 further depicts an enlarged map 204 of a portion 206 of the geographic region 202. The enlarged map 204 illustrates part of a road network 208 in the geographic region 202. The road network 208 includes, among other things, roads and intersections located in the geographic region 202. As shown in the portion 206, each road in the geographic region 202 is composed of one or more road segments 210. A road segment 210 represents a portion of the road. Each road segment 210 is shown to have associated with the road segment 210, two nodes 212; one node represents the point at one end of the road segment and the other node represents the point at the other end of the road segment. The node 212 at either end of a road segment 210 may correspond to a location at which the road meets another road, i.e., an intersection, or where the road dead-ends.

Figure 12:
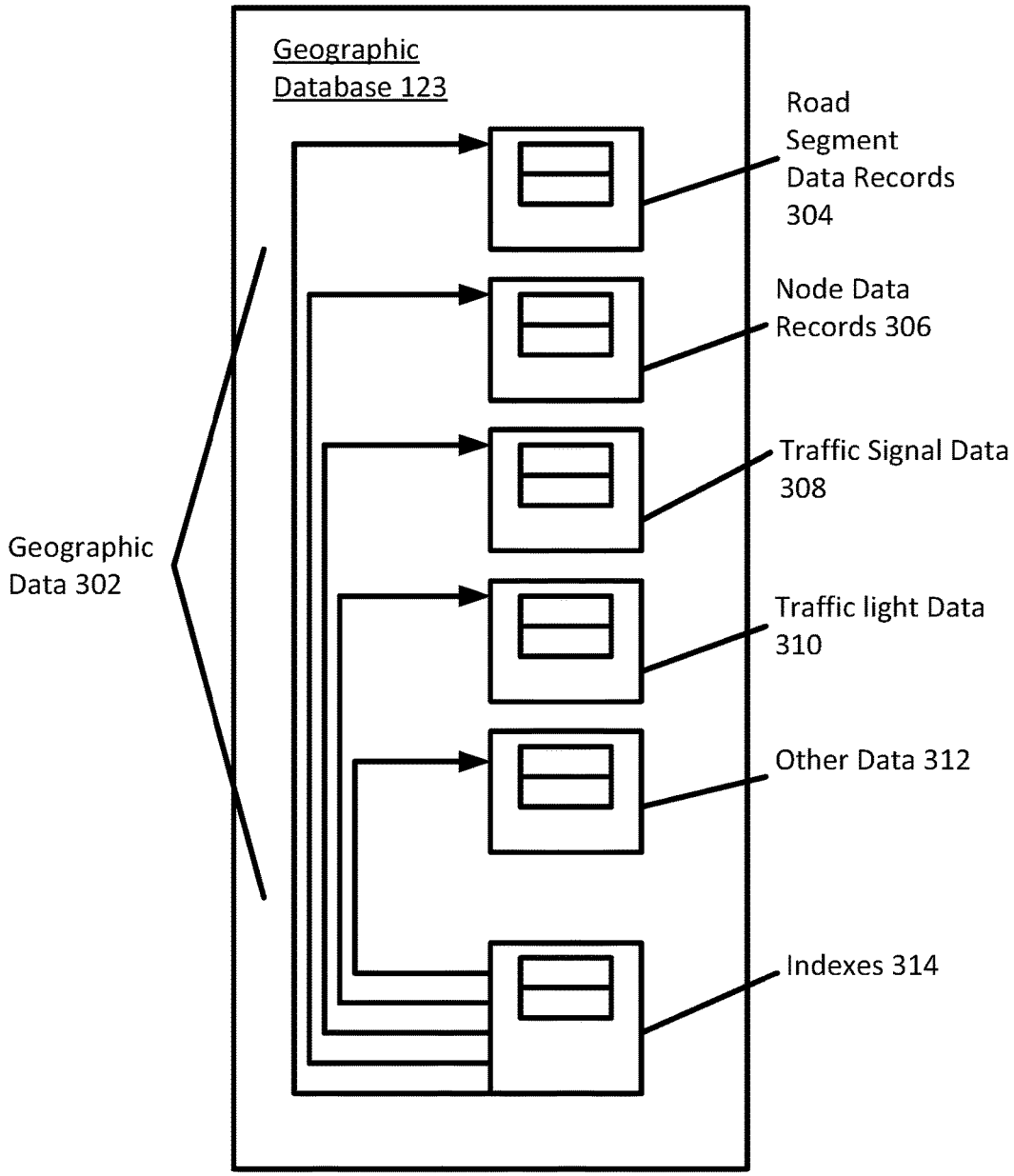
FIG. 12 illustrates an example geographic database of FIG. 3.

FIG. 12 depicts an example geographic database 123. The geographic database 123 contains data 302 that represents some of the physical geographic features in the geographic region 202 depicted in FIG. 3. The data 302 contained in the geographic database 123 may include data that represent the road network 208. In the embodiment of FIG. 4, the geographic database 123 that represents the geographic region 202 may contain at least one road segment database record 304 (also referred to as "entity" or "entry") for each road segment 210 in the geographic region 202. The geographic database 123 that represents the geographic region 202 may also include a node database record 306 (or "entity" or "entry") for each node 212 in the geographic region 202. The terms "nodes" and "segments" represent only one terminology for describing the physical geographic features, and other terminology for describing the features is intended to be encompassed within the scope of the concepts.

The geographic database 123 may also include other kinds of data 312. The other kinds of data 312 may represent other kinds of geographic features or anything else. The other kinds of data may include point of interest data. For example, the point of interest data may include point of interest records including a type (e.g., the type of point of interest, such as restaurant, hotel, city hall, police station, historical marker, ATM, golf course, etc.), location of the point of interest, a phone number, hours of operation, etc. The geographic database 123 also includes indexes 314. The indexes 314 may include various types of indexes that relate the different types of data to each other or that relate to other aspects of the data contained in the geographic database 123. For example, the indexes 314 may relate the nodes in the node data records 306 with the end points of a road segment in the road segment data records 304. As another example, the indexes 314 may relate point of interest data in the other data records 312 with a road segment in the segment data records 304.

FIG. 13 depicts some of the components of a road segment data record 304 contained in the geographic database 123 according to one embodiment. The road segment data record 304 may include a segment ID 304(1) by which the data record can be identified in the geographic database 123. Each road segment data record 304 may have associated with it information (such as "attributes", "fields", etc.) that describes features of the represented road segment. The road segment data record 304 may include data 304(2) that indicate the restrictions, if any, on the direction of vehicular travel permitted on the represented road segment. The road segment data record 304 may include data 304(3) that indicate a speed limit or speed category (i.e., the maximum permitted vehicular speed of travel) on the represented road segment. The road segment data record 304 may also include data 304(4) indicating whether the represented road segment is part of a controlled access road (such as an expressway), a ramp to a controlled access road, a bridge, a tunnel, a toll road, a ferry, and so on.

Data for traffic signals 126 may be stored as separate records 308, 310 or in road segment data records 304. The traffic signal data 308 and traffic light data 310 may include data such as SPaT data for individual traffic signals 126 if available. The data for the traffic signals 126 may include data as it relates to other information in the geographic database 123 such as road segment data records 304. The geographic database 123 may include road segment data records 304 (or data entities) that describe features such as intersection congestion 304(5) or data related to outages 304(6). Additional geographic and network usage data may be stores in other data 312. The attribute data may be stored in relation to a link/segment 304, a node 306, a strand of links, an area, or a region.

The geographic database 123 may store information or settings for display preferences. The geographic database 123 may be coupled to a display. The display may be configured to display the roadway network and data entities using different colors or schemes. The geographic database 123 may store and display information relating to where conditions or malfunctions may exist or have existed, for example, through analysis of the current and historical traffic conditions.

The road segment data record 304 also includes data 304(7) providing the geographic coordinates (e.g., the latitude and longitude) of the end points of the represented road segment. In one embodiment, the data 304(7) are references to the node data records 306 that represent the nodes corresponding to the end points of the represented road segment.

The road segment data record 304 may also include or be associated with other data 304(7) that refer to various other attributes of the represented road segment. The various attributes associated with a road segment may be included in a single road segment record, or may be included in more than one type of record that cross-references to each other. For example, the road segment data record 304 may include data identifying what turn restrictions exist at each of the nodes that correspond to intersections at the ends of the road portion represented by the road segment, the name or names by which the represented road segment is known, the street address ranges along the represented road segment, and so on.

FIG. 13 also shows some of the components of a node data record 306 that may be contained in the geographic database 123. Each of the node data records 306 may have associated information (such as "attributes", "fields", etc.) that allows identification of the road segment(s) that connect to it and/or a geographic position (e.g., its latitude and longitude coordinates or location in a cellular map or network). For the embodiment shown in FIG. 5, the node data records 306(1) and 306(2) include the latitude and longitude coordinates 306(1)(1) and 306(2)(1) for their node. The node data records include the traffic signal data 306(1)(2) and 306(2)(2). The traffic signal data may store congestion data or traffic data relating to the intersection (flow, speed, etc.). The traffic light data records 306(1) and 306(2) may also include other data 306(1)(3) and 306(2)(3) that refer to various other attributes of the individual traffic light. The traffic light data may, for example, store turning restrictions or alternative patterns for certain times of the day for each individual traffic light.

The geographic database 123 may be maintained by a content provider (e.g., a map developer). By way of example, the map developer may collect geographic data to generate and enhance the geographic database 123. The map developer may obtain data from sources, such as businesses, municipalities or respective geographic authorities. In addition, the map developer may employ field personnel to travel throughout the geographic region to observe features and/or record information about the roadway. Remote sensing, such as aerial or satellite photography, may be used.

The geographic database 123 and the data stored within the geographic database 123 may be licensed or delivered on-demand. Other navigational services or MNOs may access the traffic data and the traffic signal malfunction data stored in the geographic database 123. Traffic signal malfunction data may be broadcast as a service.

Figure 14:
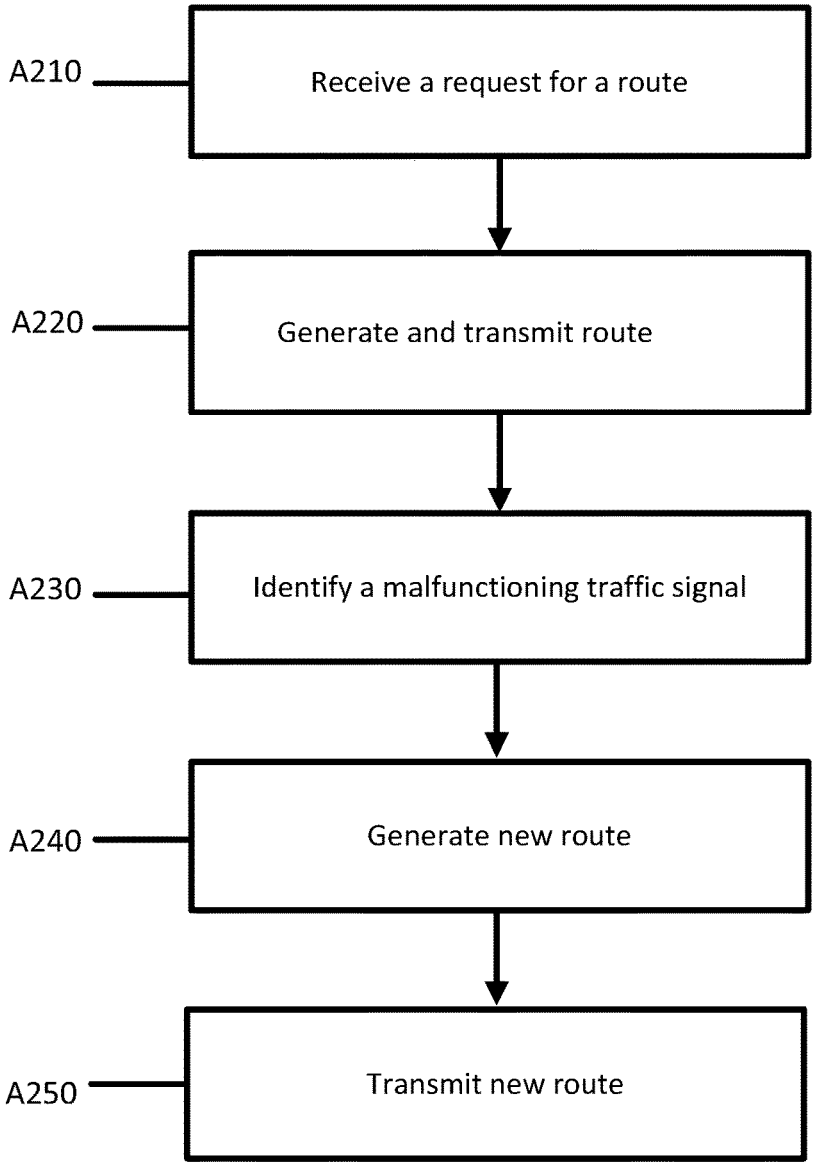
FIG. 14 illustrates an example workflow for transmitting a notification relating to a traffic signal malfunction.

FIG. 14 illustrates a flow chart of a method for determining a traffic signal is malfunctioning and transmitting a new updated route. As presented in the following sections, the acts may be performed using any combination of the components indicated in FIG. 2. The following acts may be performed by a device 122, the server 125, the location cloud 121, or a combination thereof. Additional, different, or fewer acts may be provided. The acts are performed in the order shown or other orders. The acts may also be repeated.

Figure 15:
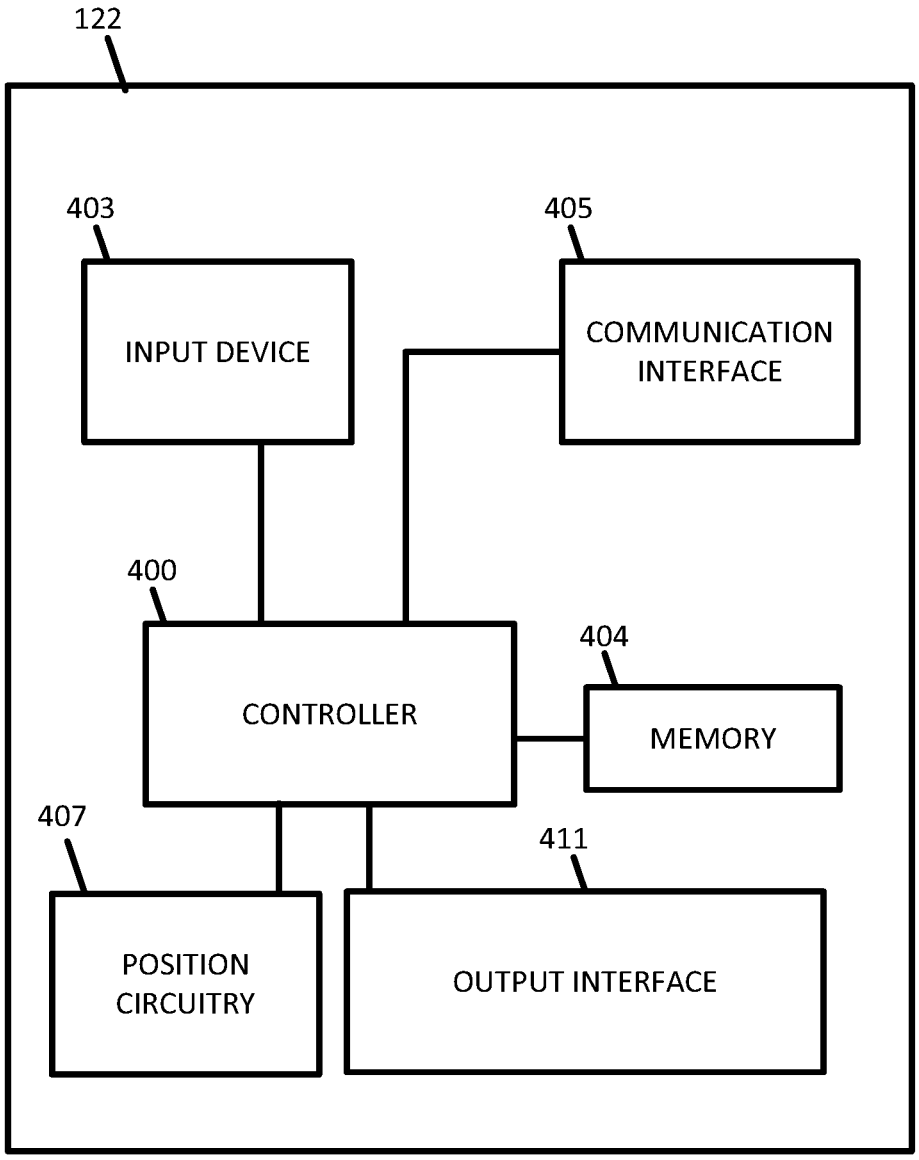
FIG. 15 illustrates an example device of the system of FIG. 2.

At Act 210, the location cloud 121 receives a request for a route. The request may be received from a device 122. FIG. 15 depicts an example device 122. The device 122 may be the means for transmitting and receiving traffic related data including probe reports and routing information. The device 122 may be configured to generate or receive a route and display the route for a user. The device 122 includes an input device 403, a communications interface 405, a controller 400, a memory 404, position circuitry 407, and an output interface 411. The device 122 may be configured to receive a traffic light malfunctioning message from a location cloud 121. The device 122 may be configured to take preemptive actions relating to malfunctioning traffic signal 126 such as generating a different route.

The memory 404 and/or memory 801 may be a volatile memory or a non-volatile memory. The memory 404 and/or memory 801 may include one or more of a read only memory (ROM), random access memory (RAM), a flash memory, an electronic erasable program read only memory (EEPROM), or other type of memory. The memory 204 and/or memory 801 may be removable from the mobile device 122, such as a secure digital (SD) memory card. The memory may contain a locally stored map database.

The controller 400 and/or processor 800 may include a general processor, digital signal processor, an application specific integrated circuit (ASIC), field programmable gate array (FPGA), analog circuit, digital circuit, combinations thereof, or other now known or later developed processor. The controller 400 and/or processor 300 may be a single device or combinations of devices, such as associated with a network, distributed processing, or cloud computing. The controller 400 may be configured to receive position information from the positioning circuitry 407 and transmit a location of the device 122.

The positioning circuitry 407, that is an example of a positioning system, is configured to determine a geographic position of the device 122. The positioning circuitry may use, for example, a GNSS receiver to determine the location of the device 122. The positioning circuitry may include movement circuitry. The movement circuitry, that is an example a movement tracking system, is configured to determine movement of a device 122. The position circuitry 407 and the movement circuitry may be separate systems, or segments of the same positioning or movement circuitry system. In an embodiment, components as described herein with respect to the device 122 may be implemented as a static device.

The input device 403 may be one or more buttons, keypad, keyboard, mouse, stylist pen, trackball, rocker switch, touch pad, voice recognition circuit, or other device or component for inputting data to the device 122. The input device 403 and the output interface 411 may be combined as a touch screen that may be capacitive or resistive. The output interface 411 may be a liquid crystal display (LCD) panel, light emitting diode (LED) screen, thin film transistor screen, or another type of display. The output interface 411 may also include audio capabilities, or speakers.

The communication interface 405 and/or communication interface 805 may include any operable connection. An operable connection may be one in which signals, physical communications, and/or logical communications may be sent and/or received. An operable connection may include a physical interface, an electrical interface, and/or a data interface. The communication interface 405 and/or communication interface 805 provides for wireless and/or wired communications in any now known or later developed format. The communication interface 405 and/or communication interface 805 may include a receiver/transmitter for digital radio signals or other broadcast mediums. A receiver/transmitter may be externally located from the device 122 such as in or on a vehicle.

At Act 220, the location cloud 121 generates and transmits the route. The route may include a requested starting point (or a current position of the device 122) and a requested destination. The route may be generated based on distance, time, efficiency, or other factors. The route may include one or more road segments that connect the starting point and the destination including one or more intersections with one or more traffic signals 126. The route may be provided with traffic information from the map database 123.

At Act 230, the location cloud 121 identifies a traffic signal 126 that is malfunctioning on the route. The location cloud 121 may receive multiple probe reports from different vehicles or devices 122 traveling the roadway. From the probe reports, the location cloud 121 may be able to determine if a traffic signal 126 or traffic light has malfunctioned.

Figure 16:
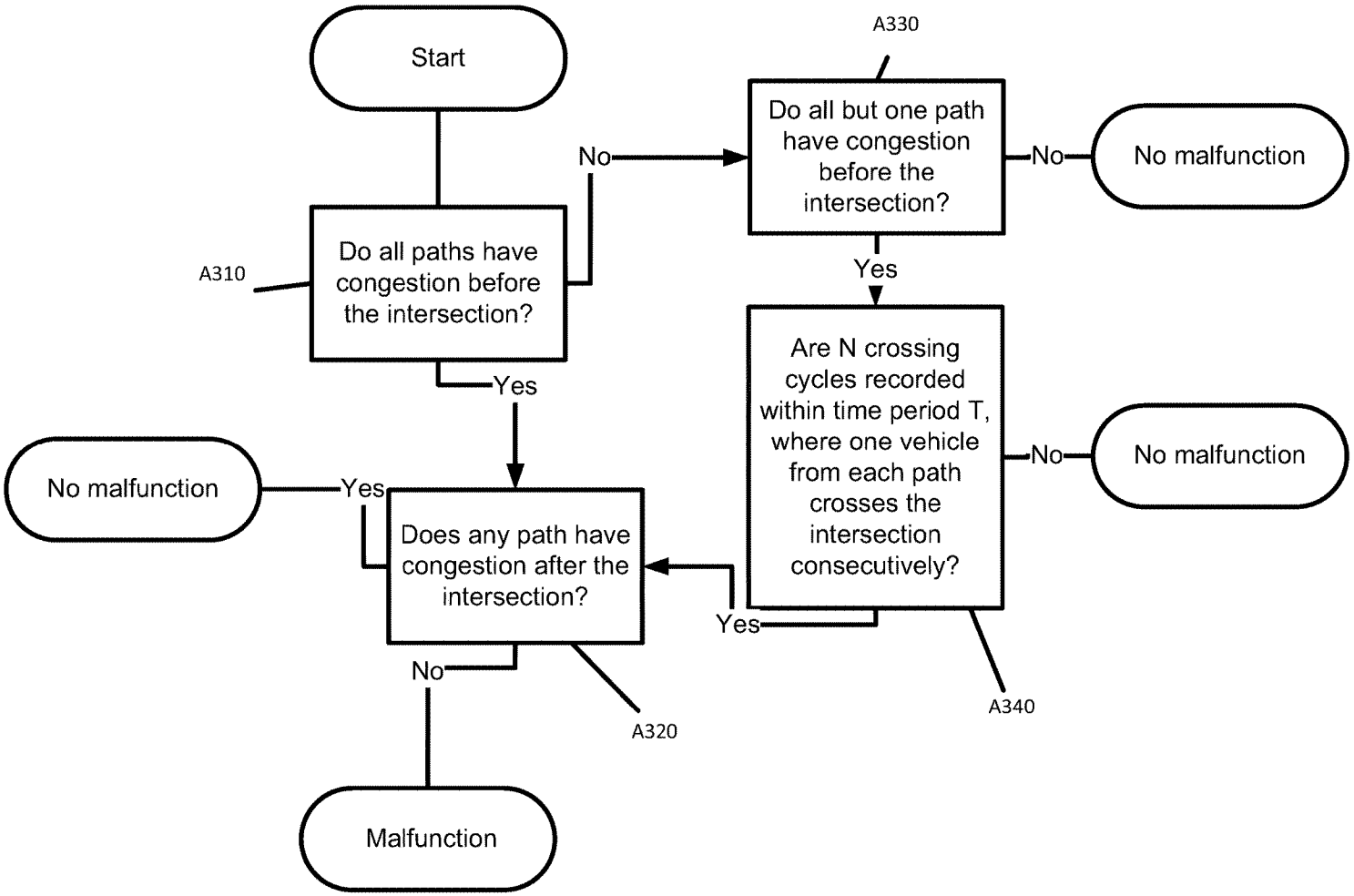
FIG. 16 illustrates an example workflow for identifying a malfunctioning traffic signal.

FIG. 16 illustrates a flow chart of a method for identifying a malfunctioning traffic signal. As presented in the following sections, the acts may be performed using any combination of the components indicated in FIG. 3. The following acts may be performed by the device 122, the server 125, the location cloud 121, or a combination thereof. Additional, different, or fewer acts may be provided. The acts are performed in the order shown or other orders. The acts may also be repeated.

The flow chart starts by receiving one or more probe reports from one or more devices and identifying congestion and crossing cycles from the probe reports. In the scenario for FIG. 16, the intersection is a four-way intersection with only straight paths through the intersection. The intersection is similar to the intersection described in FIGS. 5 through 8.

At act A310, the location cloud determines if all paths have congestion before the intersection. Congestion may be as simple as one or more stationary vehicles. Congestion may also be determined based on traffic flow over a time period. If the location cloud determines that there is congestion before the intersection on all paths, the workflow moves to A320. If there is not congestion before the intersection on all paths, the workflow moves to A330.

At act A320, the location cloud determines if any path has congestion after the intersection. If any path has congestion, the location cloud determines there is no malfunction. If every path has congestion after the intersection, the location cloud determines there is a malfunction.

At act A330, the location cloud determines if all but one path has congestion before the intersection. If there is congestion on all but one path, the workflow advances to A340. For a four-way intersection with four paths, this scenario includes three paths with congestion before the intersection and one path without congestion. If there is not congestion on all but one path, the location cloud determines there is no malfunction.

At act A340, the location cloud determines if N crossing cycles are recorded in for a time period T where one vehicle from each direction crosses the intersection consecutively. Crossing cycles (e.g. the time period where all directions get one turn of right of way) are used to identify the one path has a working light or if the traffic signal has malfunctioned. In a crossing cycle a direction may or may not provide a vehicle to cross the intersection. If within a time period of T, N crossing cycles are recorded where one vehicle from each direction crosses the intersection consecutively, then the location cloud may determine there is a possibility of an intersection wide traffic light outage and advance to Act A320. Otherwise, the location cloud determines that lights and traffic signal are working properly and the workflow returns no malfunction. In an example, the number of crossing cycles N=five, and there are four directions. The location cloud identifies the following sequence of crossing cycles (expressed as total number of vehicles provided by all directions in that cycle) within time T: 4-4-3-3-3-4-3-4-3-

4-3-4-4-3. Within time period T there are seven crossing cycles where all directions provided a vehicle to cross the intersection (occurrences of '4'). The threshold N is five; therefore, a malfunction is possible.

Figure 17:
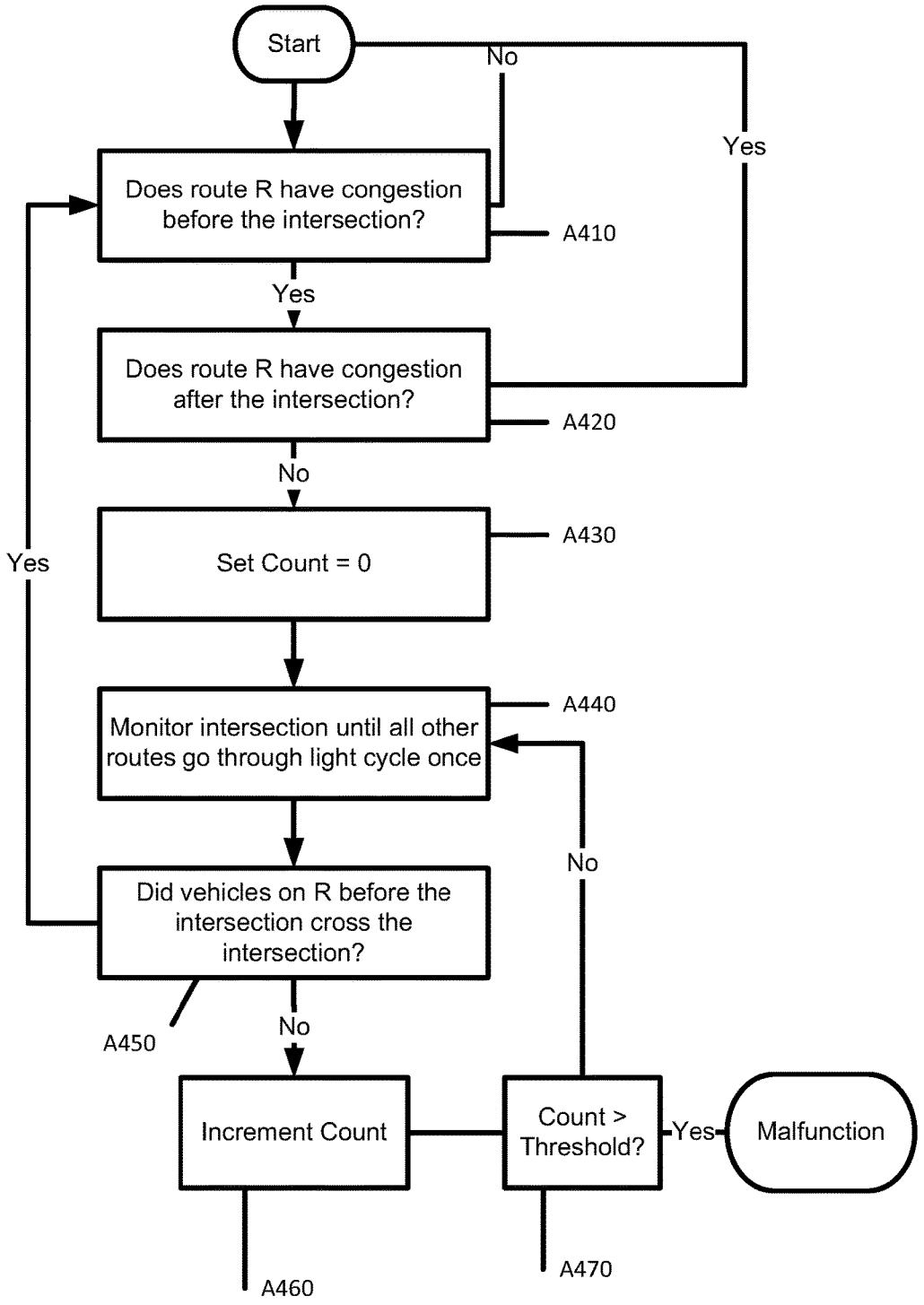
FIG. 17 illustrates an example workflow for identifying a malfunctioning traffic light.

In addition to determining a total outage of a traffic signal, the location cloud may determine if one or more traffic lights of the traffic signal are malfunctioning. FIG. 17 illustrates a flow chart of a method for identifying a malfunctioning traffic light. As presented in the following sections, the acts may be performed using any combination of the components indicated in FIG. 3. The following acts may be performed by the device 122, the server 125, the location cloud 121, or a combination thereof. Additional, different, or fewer acts may be provided. The acts are performed in the order shown or other orders. The acts may also be repeated.

The flow chart starts by receiving one or more probe reports from one or more devices and identifying congestion and vehicular crosses from the probe reports. In the scenario for FIG. 17, the intersection is a four-way intersection with only straight paths through the intersection. The intersection is similar to the intersection described in FIGS. 9A and 9B.

At act A410, the location cloud determines if route R has congestion before the intersection. A route R may represent, for example, the route from A1 to C2 in FIGS. 9A and 9B. The route R is one of four possible routes through the intersection. If there is no congestion, the workflow restarts.

At act A420, the location cloud determines if route R has congestion after the intersection. Congestion may be determining by identifying the location and timing of the one or more probe report to identify, for example, that a vehicle is stationary for a period of time after the intersection. If there is congestion, the workflow restarts. Congestion after the intersection may indicate that a vehicle is unable to cross the intersection without blocking the intersection rather than the traffic light not working properly.

At act A430, a counter is set to 0. The counter may count a number of light cycles where no vehicles are detected as crossing on route R. The counter may start at zero and be incremented until the counter crosses a threshold at act A470, a time period expires, or a set number of light cycles have occurred.

At act A440, the location cloud monitors the intersection until all other routes go through a light cycle once. A light cycle may be identified as a period of time where each light has had a chance to be green. The light cycle may be derived from identifying crossing on other routes by other vehicles.

At act A450, the location cloud determines if any vehicles on route R before the intersection crossed the intersection. If, for example, a vehicle crosses on route R, then the location cloud may determine that the traffic light is working properly and the workflow may restart. If, however, during a light cycle, a vehicle does not cross on route R (even though there is congestion on route R before the intersection), the location cloud may determine that something is amiss. Accordingly, at act A460, the counter is incremented. A counter is used to eliminate false positives. For example, a driver of a vehicle may not have paid attention to the light and therefore not crossed. In another example, one or more pedestrians may have blocked the vehicle from crossing. In both these scenarios, the counter may be incremented. Immediately identifying the traffic light as malfunctioning would be an error.

At act A470, the counter is compared to a threshold. A single non-crossing event for a light cycle may not be enough to indicate that a traffic light is malfunctioning. As such, the threshold may be set to two of more instances of non-crossing events before the location cloud may make a determination that the traffic light is not working properly.

Referring back to the flowchart of FIG. 16, at act A240, the location cloud 121 generates a new route that does not include the intersection. A malfunctioning traffic light may cause multiple issues including but not limited to increase congestion surrounding the intersection, less traffic flow, and increased travel times. As such, avoiding malfunctioning traffic lights may be a high priority. The location cloud 121 may identify any routes that include the traffic signal 126 and or identify any devices 122 that are expected to enter the affected region surrounding the traffic signal 126. The location cloud 121 may generate new routes that avoid the affected areas.

At act A250, the location cloud 121 transmits the new route to the device 122. The location cloud 121 may transmit an alert to devices 122 in the area. The devices 122 may use the alert to generate a new route around the affected area.

The term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

As used in this application, the term 'circuitry' or 'circuit' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Navigation Satellite System (GNSS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The memory may be a non-transitory medium such as a ROM, RAM, flash memory, etc. The processor and the memory can be supplemented by, or incorporated in, special purpose logic circuitry.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

The following embodiments are disclosed.

Embodiment 1

A method for determining when a traffic signal associated with one or more paths through a road intersection is malfunctioning. The method comprises: receiving a plurality of probe reports from a plurality of devices; identifying whether there is congestion prior to and subsequent to the road intersection for the one or more paths; and determining a traffic signal malfunction based on the whether or not congestion is identified prior to and subsequent to the road intersection.

Embodiment 2 the method of embodiment 1, wherein a traffic signal malfunction is determined when there is congestion prior to the road intersection for all paths of the one or more paths and no congestion subsequent to the road intersection for all paths of the one or more paths.

Embodiment 3 the method of embodiments 1-2, further comprising calculating a number of crossing cycles for the road intersection within a time period; wherein the traffic signal malfunction is determined when the number of crossing cycles equals a threshold crossing cycle count and there is identified congestion prior to the road intersection for all but one path of the one or more paths and there is no identified congestion subsequent to the road intersection for all paths of the one or more paths.

Embodiment 4 the method of embodiments 1-3, wherein the threshold crossing cycle count is two or more crossing cycles.

Embodiment 5 the method of embodiments 1-4, further comprising calculating one or more routes through the road intersection for a light cycle and determining zero crosses for one of the one or more routes through the road intersection for the light cycle. The traffic signal malfunction is determined when a threshold number of light cycles repeat, each with zero crosses for the one route of the one or more routes, and there is congestion prior to the road intersection on the one route and no congestion subsequent to the road intersection for the one route.

Embodiment 6 the method of embodiments 1-5, wherein the threshold number of light cycles is two.

Embodiment 7 the method of embodiments 1-6, further comprising transmitting a malfunctioning traffic signal alert message for the traffic signal.

Embodiment 8 the method of embodiments 1-7, wherein the malfunctioning traffic signal alert message is transmitted to one or more devices within a threshold distance from the road intersection.

Embodiment 9 the method of embodiments 1-8, wherein identifying whether there is congestion comprises identifying from the plurality of probe reports if there are one or more stationary vehicles on each path prior to the road intersection and identifying from the plurality of probe reports if there are one or more stationary vehicles on each path subsequent to the road intersection.

Embodiment 10 a system for determining when a traffic signal associated with a road intersection is malfunctioning. The system comprises a map database configured to store data relating to the road intersection, a sensor ingestion module configured to receive and store in the map database a plurality of probe reports from a plurality of probe devices, a routing module configured to generate a plurality of crossing routes for the road intersection for a time period, and an analytics module configured to analyze the plurality of probe reports to determine congestion before and after the road intersection; the analytics module configured to determine a number of crossing cycles for the road intersection using the plurality of crossing routes; the analytics module further configured to determine the traffic signal has malfunctioned when there is congestion before the road intersection for all paths and no congestion after the road intersection for all paths; the analytics module further configured to determine the traffic signal has malfunctioned when there is congestion in all but one path before the road intersection, no congestion after the road intersection for all paths, and when the number of crossing cycles equals a predefined threshold.

Embodiment 11 the system of embodiment 10, further comprising a notification module configured to transmit an alert message for a malfunctioning traffic signal.

Embodiment 12 the system of embodiments 10-11, wherein the notification module is configured to transmit the alert message to one or more devices within a threshold distance from the road intersection.

Embodiment 13 the system of embodiments 10-12, wherein the predefined threshold is five crossing cycles.

Embodiment 14 the system of embodiments 10-13, wherein the analytics module is further configured to calculate one or more routes through the road intersection for a light cycle; determine zero crosses for one of the one or more routes through the road intersection for the light cycle; and determine a traffic signal malfunction when a threshold number of light cycles repeat, each with zero crosses for the one route of the one or more routes, and there is congestion prior the road intersection on the one route and no congestion subsequent to the road intersection for the one route.

Embodiment 15 the method of embodiments 10-14 wherein the threshold number of light cycles is two.

Embodiment 16 a method for generating an updated route. The method comprises: receiving a request for a route, generating, by a processor, the route, providing, by the processor, the route, identifying, by the processor, whether there is congestion prior to and subsequent to a road intersection, determining, by the processor, a traffic signal at the road intersection has malfunctioned based on whether there is congestion, generating, by the processor, an updated route not including the road intersection, and providing, by the processor, the updated route.

Embodiment 17 the method of embodiment 16, wherein determining the traffic signal at the road intersection has malfunctioned comprises determining there is congestion prior to the road intersection for all paths of the one or more paths and no congestion subsequent to the road intersection for all paths of the one or more paths.

Embodiment 18 the method of embodiments 16-17, wherein determining the traffic signal at the road intersection has malfunctioned comprises calculating a number of crossing cycles for the road intersection within a time period and determining that the number of crossing cycles equals a threshold crossing cycle count and there is identified congestion prior to the road intersection for all but one path of the one or more paths and there is no identified congestion subsequent to the road intersection for all paths of the one or more paths.

Embodiment 19 the method of embodiments 16-18, wherein the threshold crossing cycle count is five or more crossing cycles.

Embodiment 20 the method of embodiments 16-19, wherein determining the traffic signal at the road intersection has malfunctioned comprises calculating one or more routes through the road intersection for a light cycle, determining zero crosses for one of the one or more routes through the road intersection for the light cycle, and determining that a threshold number of light cycles have repeated consecutively, each with zero crosses for the one route of the one or more routes, and there is congestion prior the road intersection on the one route and no congestion subsequent to the road intersection for the one route.

Embodiment 21 an apparatus, configured to perform and/or control the method of any of embodiments 1-9 or comprising means for performing and/or controlling any of embodiments 1-9.

Embodiment 22 an apparatus, comprising at least one processor and at least one memory including computer program code for one or more programs, the at least one memory and the computer program code configured to, with the at least one processor, to perform and/or control the method of any of embodiments 1-9.

Embodiment 23 a computer program comprising instructions operable to cause a processor to perform and/or control the method of any of embodiments 1-9, when the computer program is executed on the processor.

We claim:

1. A method for determining when a traffic signal associated with one or more paths through a road intersection is malfunctioning, the method comprising:

receiving a plurality of probe reports from a plurality of devices;

identifying whether there is congestion prior to and subsequent to the road intersection for the one or more paths;

calculating a number of crossing cycles for the road intersection within a time period; and determining a traffic signal malfunction when the number of crossing cycles equals a threshold crossing cycle count and there is identified congestion prior to the road intersection for all but one path of the one or more paths and there is no identified congestion subsequent to the road intersection for all paths of the one or more paths.

2. The method of claim 1, wherein the threshold crossing cycle count is two or more crossing cycles.

3. The method of claim 1, further comprising:

transmitting a malfunctioning traffic signal alert message for the traffic signal.

4. The method of claim 3, wherein the malfunctioning traffic signal alert message is transmitted to one or more devices within a threshold distance from the road intersection.

5. The method of claim 1, wherein identifying whether there is congestion comprises:

identifying from the plurality of probe reports if there are one or more stationary vehicles on each path prior to the road intersection; and identifying from the plurality of probe reports if there are one or more stationary vehicles on each path subsequent to the road intersection.

6. A system for determining when a traffic signal associated with a road intersection is malfunctioning, the system comprising:

a map database configured to store data relating to the road intersection;

a sensor ingestion module configured to receive and store in the map database a plurality of probe reports from a plurality of probe devices;

a routing module configured to generate a plurality of crossing routes for the road intersection for a time period; and an analytics module configured to analyze the plurality of probe reports to determine congestion before and after the road intersection; the analytics module configured to determine a number of crossing cycles for the road intersection using the plurality of crossing routes; the analytics module further configured to determine the traffic signal has malfunctioned when there is congestion before the road intersection for all paths and no congestion after the road intersection for all paths; the analytics module further configured to determine the traffic signal has malfunctioned when there is congestion in all but one path before the road intersection, no congestion after the road intersection for all paths, and when the number of crossing cycles equals a predefined threshold.

7. The system of claim 6, further comprising:

a notification module configured to transmit an alert message for a malfunctioning traffic signal.

8. The system of claim 7, wherein the notification module is configured to transmit the alert message to one or more devices within a threshold distance from the road intersection.

9. The system of claim 6, wherein the predefined threshold is five crossing cycles.

10. The system of claim 6, wherein the analytics module is further configured to calculate one or more routes through the road intersection for a light cycle; determine zero crosses for one of the one or more routes through the road intersection for the light cycle; and determine a traffic signal malfunction when a threshold number of light cycles repeat, each with zero crosses for the one route of the one or more routes, and there is congestion prior the road intersection on the one route and no congestion subsequent to the road intersection for the one route.

11. The method of claim 10, wherein the threshold number of light cycles is two.

12. The method of claim 1, further comprising:

generating a route from a starting point to a destination; wherein the route is generated at least as a function of the determination of the traffic signal malfunction.

13. The method of claim 12, wherein the route excludes the road intersection when a traffic signal malfunction is determined.

14. A method for determining when a traffic signal associated with one or more paths through a road intersection is malfunctioning, the method comprising:

receiving a plurality of probe reports from a plurality of devices;

identifying whether there is congestion prior to and subsequent to the road intersection for the one or more paths;

calculating one or more routes through the road intersection for a light cycle; and determining zero crosses for one of the one or more routes through the road intersection for the light cycle; and determining a traffic signal malfunction when a threshold number of light cycles repeat, each with zero crosses for the one route of the one or more routes, and there is congestion prior to the road intersection on the one route and no congestion subsequent to the road intersection for the one route.

15. The method of claim 14, wherein the threshold number of light cycles is two.

16. The method of claim 14, further comprising:

transmitting a malfunctioning traffic signal alert message for the traffic signal.

17. The method of claim 16, wherein the malfunctioning traffic signal alert message is transmitted to one or more devices within a threshold distance from the road intersection.

* * * * *